US005577897A

United States Patent [19]

Inagaki et al.

[11] Patent Number: 5,577,897

[45] Date of Patent: Nov. 26, 1996

[54] SCROLL-TYPE VARIABLE-CAPACITY COMPRESSOR HAVING TWO CONTROL VALVES

[75] Inventors: Mitsuo Inagaki; Mikio Matsuda, both of Okazaki; Kazuhide Uchida, Hamamatsu; Hideaki Sasaya, Okazaki, all of Japan

[73] Assignees: Nippondenso Co., Ltd., Kariya; Nippon Soken, Inc., Nishio, both of Japan

[21] Appl. No.: 457,410

[22] Filed: Jun. 1, 1995

Related U.S. Application Data

[62] Division of Ser. No. 38,106, Mar. 30, 1993, Pat. No. 5,451,146.

[30] Foreign Application Priority Data

Apr. 1, 1992 [JP] Japan ..... 4-79886
May 27, 1992 [JP] Japan ..... 4-134882

[51] Int. Cl.[6] ..... F04B 49/00

[52] U.S. Cl. ..... 417/310; 417/304; 417/308

[58] Field of Search ..... 417/304, 308, 417/310

[56] References Cited

U.S. PATENT DOCUMENTS 4,744,733 5/1988 Terauchi et al. .
5,049,044 9/1991 Hirano .
5,074,761 12/1991 Hirooka et al. ..... 417/304
5,197,987 3/1993 Iio et al. .
5,356,271 10/1994 Miura et al. ..... 417/308

FOREIGN PATENT DOCUMENTS 59-105994 6/1984 Japan .
62-90901 6/1987 Japan .
404076290 3/1992 Japan ..... 417/310

*Primary Examiner*—Timothy Thorpe
*Assistant Examiner*—Ted Kim
*Attorney, Agent, or Firm*—Cushman, Darby & Cushman; IP Group of Pillsbury; Madison & Sutro LLP

[57] ABSTRACT

A scroll compressor wherein a cylinder is provided along the end plate of a stationary scroll member and a plurality of bypass holes which open in the end plate and can communicate with the space in the cylinder and a plurality of operating spaces formed between the spiral vanes of the stationary scroll member and a moving scroll member are successively opened by a plunger to communicate with the suction side, whereby the capacity may be changed smoothly. When reducing the capacity to close to 0 percent, another cylinder and plunger are used to bypass the discharge pressure to the suction side.

5 Claims, 18 Drawing Sheets

SCROLL-TYPE VARIABLE-CAPACITY COMPRESSOR HAVING TWO CONTROL VALVES

This application is a divisional of application Ser. No. 08/038,106 filed Mar. 30, 1993, now U.S. Pat. No. 5,451, 146.

BACKGROUND OF THE INVENTION

1. Field of the Invention

The present invention relates to a scroll-type variable-capacity compressor suitable for use as a refrigerant compressor of an automobile air-conditioner, for example, in particular relates to the variable-capacity mechanism of the same.

2. Description of the Related Art

As the variable-capacity mechanisms of conventional scroll compressors, as disclosed in, for example, Japanese Unexamined Patent Publication (Kokai) No. 59-105994 and Japanese Unexamined Utility Model Publication (Kokai) No. 62-90901, a plurality of bypass holes are made in an end plate of a stationary scroll member and a plurality of plunger valves or spool valves are provided to independently open and close the bypass holes.

Since the variable-capacity mechanisms of these conventional scroll compressors had a plunger valve or spool valve provided for each of the plurality of bypass holes, there was the problem that there were a large number of parts, constructions was complicated, and the processability and the assembly ability were poor. In prior art devices, further, as is clear from their drawings, a pair of bypass valves were provided at positions symmetrical to the center of the stationary scroll member so as to enable the bypass holes to be opened and closed at the same timing for a pair of operating spaces. This reduced the number of stages of changes in the discharge capacity of the compressors. Therefore, if the compressors of the prior art devices are used for something like the refrigerant compressor of an automobile air-conditioner where the rotational speed of the drive and the cooling load vary over a wide range, the problem arises that it is difficult to maintain the discharge capacity constant in the face of these changes or to change the discharge capacity smoothly.

Further, it is difficult to provide the bypass holes at positions near the center portion of the end plate of the stationary scroll member, so in the prior art there was the problem that it was difficult to bring the minimum discharge capacity of the scroll compressor sufficiently near 0 percent. Further, when the compressor is turning at a high speed, if the opening time of the bypass holes becomes shorter, there is the problem that it no longer becomes possible to sufficiently cause bypassing of the compressed fluid in the operating spaces between the two scroll members and thus a small capacity cannot be realized. The present invention has as its object the resolution of these problems.

SUMMARY OF THE INVENTION

The present invention, as a means for achieving the above object, provides a scroll-type variable-capacity compressor which has a stationary scroll member and a moving scroll member, which pair of scroll members are provided on their end plates with spiral vanes formed in an involute shape, the stationary and moving scroll members engaging with each other to form a plurality of operating spaces, which scroll compressor is characterized in that a single cylinder is provided along the end plate of the stationary scroll member from part of the outer circumference to the center portion, the space in the cylinder is connected to the suction pressure chamber side, a group of bypass holes comprised of a plurality of bypass holes which can connect the cylinder and the plurality of operating spaces are made in the end plate of the stationary scroll member, and a plunger which can successively open and close the group of bypass holes by movement of the same is inserted in the cylinder.

The present invention, as a means for achieving the object of realizing the minimum discharge capacity, further provides a scroll-type variable-capacity compressor characterized in that in addition to the above-mentioned construction, provision is made of a second cylinder which communicates to the passage of the compressed high pressure fluid at all times, that is, the discharge pressure chamber, a suction bypass port communicating with the low pressure side is also made in addition to the discharge port constituting the main discharge path, and a second plunger is inserted in the second cylinder, whereby it is possible to switch the discharge pressure chamber to the discharge port or the suction bypass port.

In the present invention, since the cylinder is provided along the end plate of the stationary scroll member from part of the outer circumference to the center portion and a group of bypass holes comprised of a plurality of bypass holes communicating the cylinder with the operating spaces are made between the cylinder and the operating spaces and further a plunger which can successively close the group of bypass holes is inserted in the cylinder, by moving the plunger, the low pressure portion of the outer circumference of the two scroll members and a selected part of the operating spaces are communicated through the cylinder and bypass holes and the communicated operating spaces remain low in pressure with no compression even if the moving scroll member revolves and they become smaller in volume.

Therefore, when starting the compressor, if the plunger is moved in the cylinder to move the operating end face of the plunger to the position closest to the center portion of the stationary scroll member and make most of the bypass holes communicate with the cylinder, the power required for driving the moving scroll member becomes smaller and no rapidly increasing load is given to the motor, so there is no strain in the motor, the compressor is started up smoothly, and there is no torque shock given to apparatuses driven by the same motor. After startup, by moving the plunger to the outer circumference of the stationary scroll member, the bypass holes communicating with the cylinder are successively blocked, whereby the number of operating spaces performing effective compression actions is gradually increased and thus the discharge capacity of the compressor can be smoothly increased in stages.

Further, when it is not possible to achieve a sufficiently small discharge capacity just by causing bypassing of the fluid compressed in the operating spaces, it is possible to additionally make another cylinder and plunger act so as to cause bypassing of part or all of the discharge pressure to the suction pressure chamber side and thereby realize a low discharge capacity of close to 0 percent.

In this way, by making the plungers move freely in reciprocal directions in the cylinders during the steady state operation, it is possible to perform smooth control to change the discharge capacity in stages in accordance with the demand or to maintain the discharge capacity constant in the event of fluctuations in the rotational speed of the motor driving the moving scroll member. Therefore, the scroll-type variable-capacity compressor of the present invention is suited for use as a refrigerant compressor of an automobile air-conditioner, which is driven by a motor with large fluctuations in the rotational speed and which is required to change the cooling capacity over a wide range.

In the scroll-type variable-capacity compressor of the present invention, despite changing the amount of discharge over several stages, the group of bypass holes corresponding to the operating spaces are opened and closed by a common plunger, so the number of parts becomes smaller and the construction also becomes simpler, meaning superior processability and assembly ability and being advantageous in cost as well.

Other objects and advantages of the present invention will be readily understood by persons skilled in the art from the following detailed description made with reference to the appended drawings.

BRIEF DESCRIPTION OF THE DRAWINGS

In the appended drawings.

DETAILED DESCRIPTION OF THE INVENTION

Figure 1:
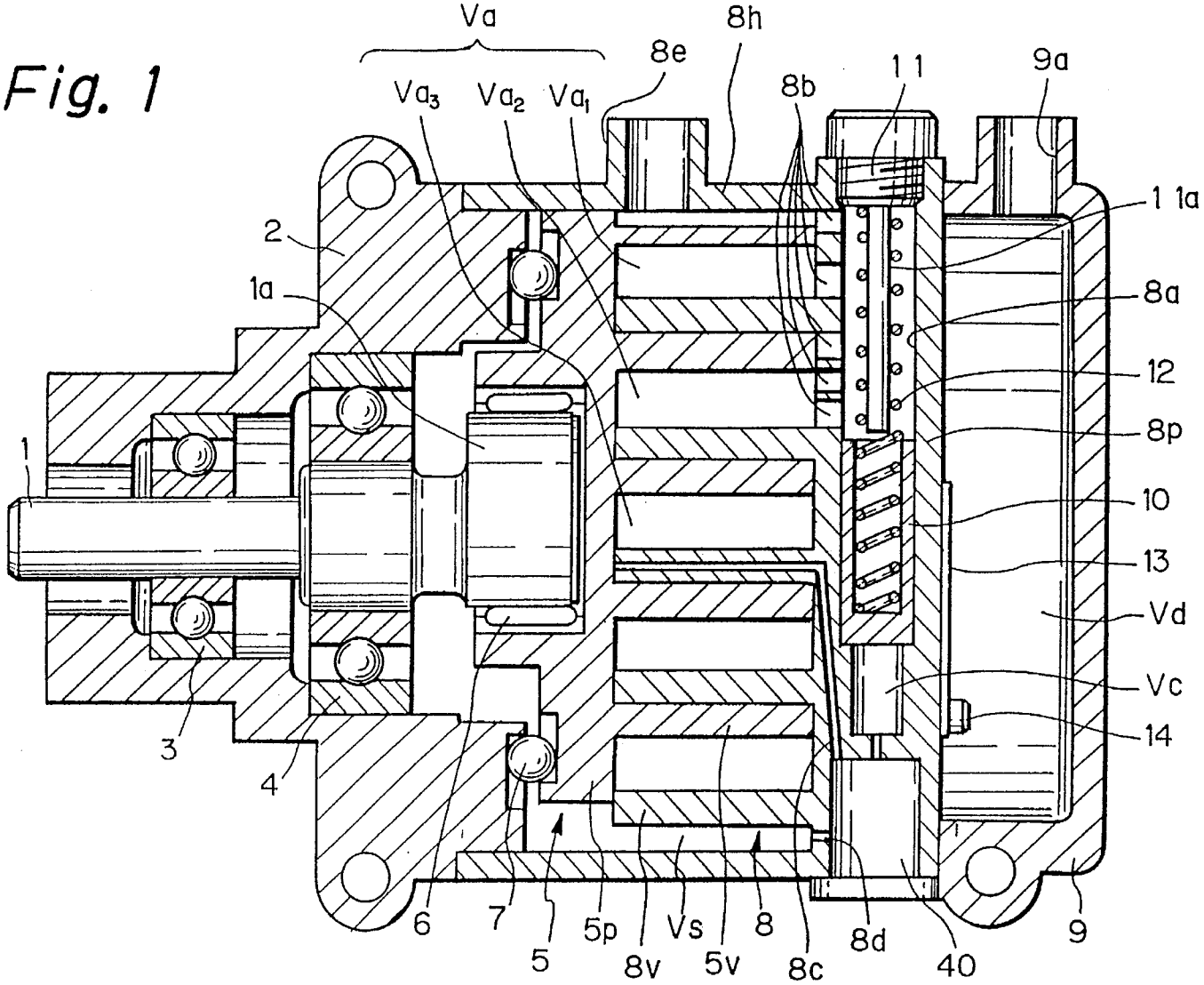
FIG. 1 is a front sectional view of a first embodiment of the present invention.
Figure 2:
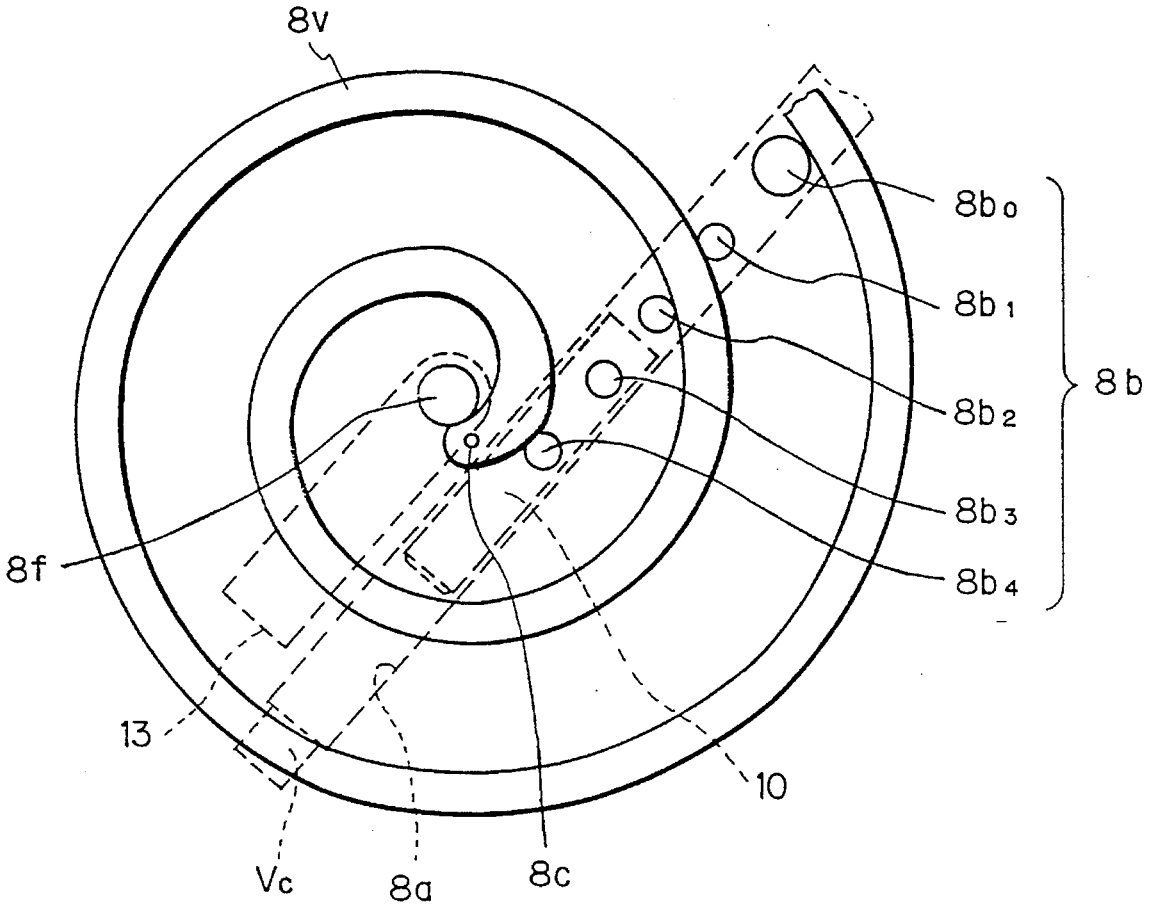
FIG. 2 is a side view of a stationary scroll member in the first embodiment.

The constitution of the scroll-type variable-capacity compressor of a first embodiment of the present invention is shown in FIG. 1 and FIG. 2. This is an example of the case the scroll compressor is used as a refrigerant compressor for an automobile air-conditioner.

In these figures, 1 is a rotational shaft which has a crank portion 1*a*. While not shown, a magnetic clutch is provided at the left end of the rotational shaft 1, through which the drive power of the automobile engine is transmitted. Reference numeral 2 is a front housing, which rotatably supports the rotational shaft 1 through the bearings 3 and 4. Reference numeral 5 is a moving scroll member, which is comprised of a spiral vane 5*v* formed in a 2.5-turn involute shape and an end plate 5*p* integrally attached to the same. The end plate 5*p* and the crank portion la of the rotational shaft 1 are joined so as to be rotatable with respect to each other through a needle bearing 6. Further, between the moving scroll member 5 and the front housing 2 is disposed what may be called a "rotation preventing mechanism" comprising a plurality of balls 7 and circular depressions. Reference numeral 8 is a stationary scroll member having a suction port 8*e*, which also has a spiral vane 8*v* formed in a 2.5-turn involute shape and an end plate 8*p*, the outer shell of which serves also as the center housing 8*h*. Reference numeral 9 is a rear housing, which has a discharge port a and is fastened and affixed by bolts, not shown, with the front housing 2 and the stationary scroll member 8.

The variable-capacity mechanism, which is the characteristic feature of the present invention, is built into the end plate 8*p* of the stationary scroll member 8 in the case of this embodiment.

Reference numeral 10 is a cylindrical plunger, which is slidingly inserted in a cylinder 8*a* formed in the end plate 8*p* of the stationary scroll member and which can successively close the four bypass holes $8b_1$ to $8b_4$, not the bypass hole $8b_0$ communicating with the operating space $Va_1$ closest to the outer circumference, among the group of bypass holes 8*b* communicating the cylinder 8*a* and the plurality of crescent shaped operating spaces Va formed between the spiral vanes 5*v* and 8*v* of the stationary scroll member 8 and the moving scroll member 5. Reference numeral 11 is a stopper bolt, which has a stopper portion 11*a* comprised of a narrow diameter columnar shape extending in the cylinder 8*a* and which is screwed into the stationary scroll member 8 to a position which restricts to a predetermined amount the amount of movement of the plunger 10 in the upward direction in FIG. 1 and FIG. 2. Reference numeral 12 is a spring, which is inserted between the stopper bolt 11 and the plunger 10 and pushes the plunger 10 in the downward direction in FIG. 1 and FIG. 2, that is, toward the center position (state shown in FIG. 1) opening all of the group of bypass holes 8*b*. Further, a control pressure chamber Vc is provided in the front end direction of the plunger 10, and a control valve 40 of a later described construction is provided, to which are connected a high pressure passage 8*c* communicating to the control pressure chamber Vc and the center portion of the spiral vane 8*v* of the stationary scroll member 8 and a low pressure passage 8*d* communicating to the suction pressure chamber Vs.

At the end plate 8p of the stationary scroll member 8, provision is made of a discharge opening 8f communicating the center operating space $Va_3$ among the plurality of operating spaces enclosed by the stationary and moving spiral vanes and the discharge pressure chamber Vd enclosed by the rear housing 9 and the end plate 8p of the stationary scroll member 8. In the discharge opening 8f, a thin reed valve 13 is affixed by a bolt 14 from the discharge pressure chamber Vd side so as to block the same.

The layout of the group of bypass holes 8b is shown in FIG. 2. In the first embodiment of the present invention, the group of bypass valves 8b is comprised of five round holes $8b_0$ to $8b_4$. The bypass hole $8b_0$ closest to the outer circumference is larger in diameter than other bypass holes $8b_1$ to $8b_4$ and is made in a position contacting the inner side of the outermost end of the spiral vane 8v of the stationary scroll member 8. The bypass hole $8b_4$ closest to the center is made in a position contacting the outer side of the innermost circumference of the spiral vane 8v. Between these two bypass holes, the three bypass holes $8b_1$, $8b_2$, and $8b_3$ are made at substantially equal intervals in the end plate 8p of the stationary scroll member 8 away from the position of the spiral vane 8v. Among the bypass holes, the diameters of the four bypass holes $8b_1$ to $8b_4$ other than the bypass hole $8b_0$ closest to the outer circumference are set to be substantially equal to the plate thickness of the spiral vane 5v of the moving scroll member 5.

Figure 3:
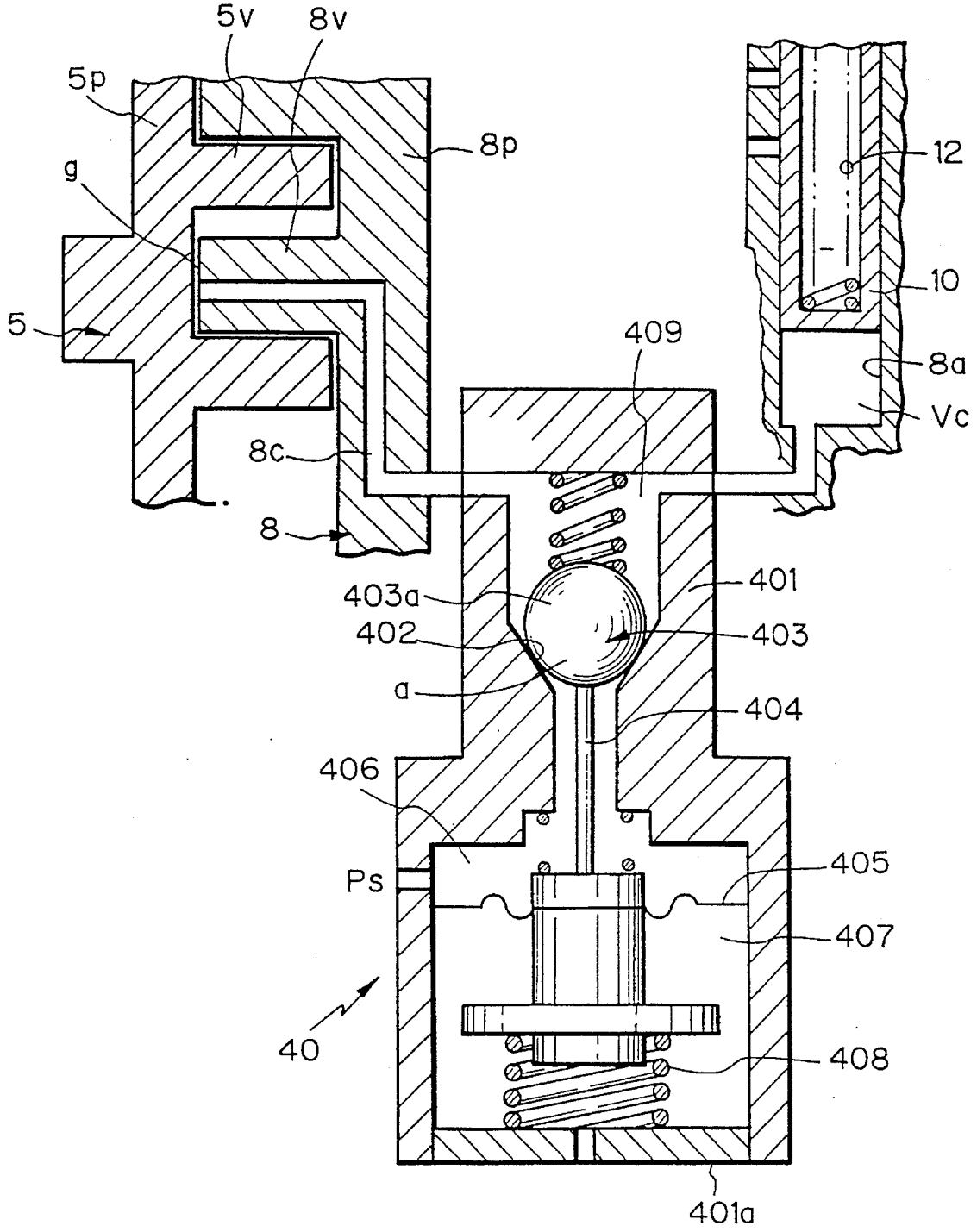
FIG. 3 is a sectional view showing an enlargement of the portion related to a control valve.
Figure 4A:
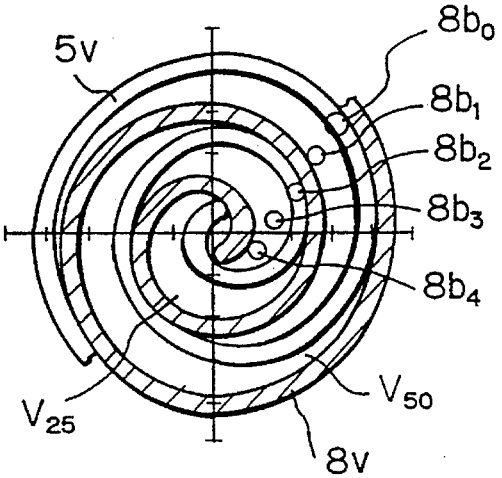
FIG. 4(*a*) to FIG. 4(*f*) are side views successively illustrating the changes in the positional relationship between the two scroll members and the group of bypass holes for explaining the operation of the compressor according to the present invention.
Figure 4D:
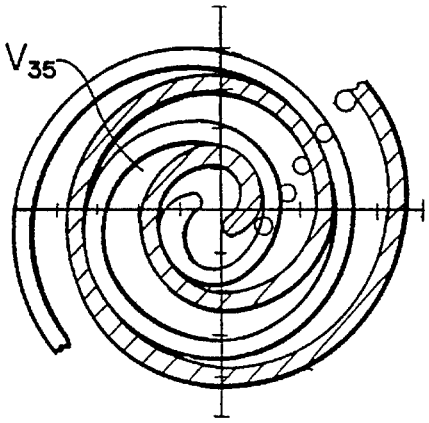
Figure 4B:
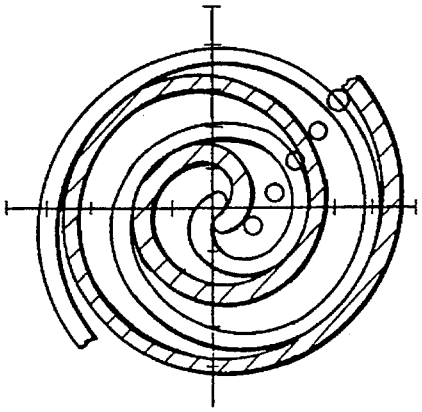
Figure 4E:
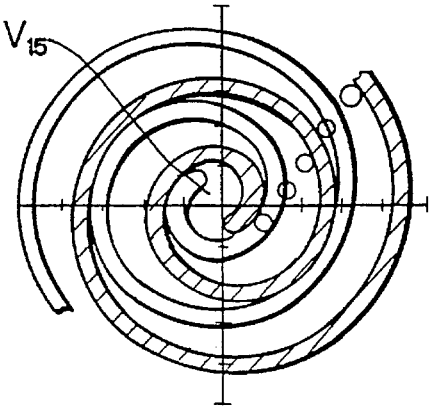
Figure 4C:
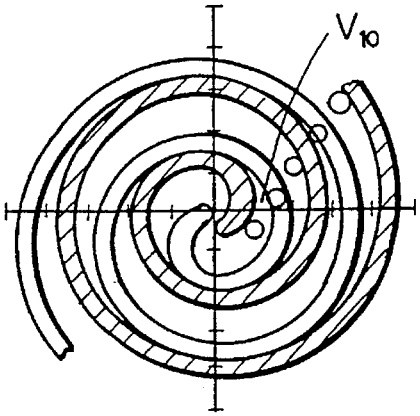
Figure 4F:
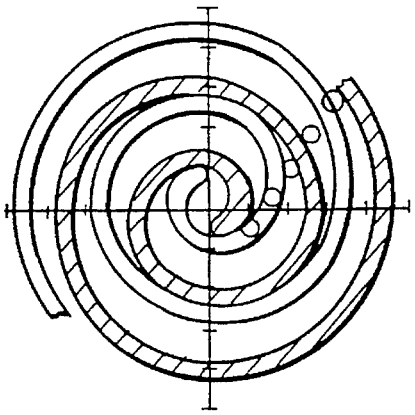

The control valve 40 leading the control pressure Pc to the control pressure chamber Vc and its related construction are shown in FIG. 3.

Reference numeral 401 is a casing having a tapered valve seat 402, while 403 is a valve body integrally connecting a ball 403a and rod 404. Reference numeral 405 is a diaphragm which is connected with the end of the rod 404 and displaces under the load caused by the differential pressure of the suction pressure Ps led into a chamber 406 at the top surface and the atmospheric pressure led to a chamber 407 at the bottom surface and the load with a spring 408 giving the setting pressure. It is assembled so that the valve body 403 can be moved upward and downward in FIG. 3. The valve portion comprised of the tapered valve seat 402 of the casing 401 and the valve body 403 is disposed between a valve chamber 409 on which the control pressure Pc acts and the chamber 406 on which the suction pressure Ps acts and opens and closes the valve portion by receiving the displacement of the diaphragm 405. Note that 401a is a cap having a hole communicating with the atmosphere.

In the control valve 40, the biasing load of the spring 408 is set so as to become equal to the load received by the diaphragm 405 moving in the downward direction in FIG. 3 when the suction pressure Ps is substantially 2 atmospheres (gauge). The valve portion is set to close with a suction pressure Ps of over 2 atmospheres (gauge), and the valve portion is set to open with a suction pressure Ps under 2 atmospheres (gauge).

First, an explanation will be made of the general compression action of the scroll-type variable-capacity compressor according to the present invention. When the rotational shaft 1 is rotated, the crank portion 1a of the rotational shaft 1 revolves the moving scroll member 5. At this time, the rotation of the moving scroll member 5 is inhibited by the action of the rotation preventing mechanism, comprised of the balls 7 and the circular depressions formed in the end plate 5p of the moving scroll member 5 and the end face of the front housing 2 facing the same. Due to this, the plurality of crescent shaped operating spaces Va formed between the spiral vanes 5v and 8v where the stationary scroll member 8 and the moving scroll member 5 engage, move from the outer circumference to the center portion while decreasing in volume. At this time, the refrigerant from the evaporator outlet side of the refrigeration cycle of the automobile air-conditioner, not shown, flows from the suction port 8e to the suction pressure chamber Vs of the compressor, is closed in at the operating space of the outermost circumference, gradually moves toward the center portion along with the rotation of the rotational shaft 1 and is compressed, and finally pushes away the reed valve 13 from the discharge opening 8f to be discharged to the discharge pressure chamber Vd and is sent from the discharge opening 8f to the condenser inlet side of the refrigeration cycle, not shown.

Next, an explanation will be made of the operation of the variable-capacity mechanism characterizing the first embodiment. When the cooling load is large and there is a need for operating at maximum capacity, if the suction pressure Ps acting on the chamber 406 of the control valve 40 shown in FIG. 3 becomes higher than 2 atmospheres (gauge), the diaphragm 405 is pushed down against the force of the spring 408, so the valve body 403 also descends and sits on the tapered valve seat 402, whereby the valve portion of the control valve 40 becomes closed. By this, the high pressure refrigerant in the center operating space is led through the high pressure passage 8c formed within a center portion of the spiral vane of the stationary scroll member 8 and opening in the direction of the end plate of the moving scroll member 5 to the control pressure chamber Vc, the control pressure P of the control pressure chamber Vc acts on the bottom face of the plunger 10, and the suction pressure Ps acts on the top surface, so when the load, corresponding to the product of the differential pressure and the sectional area of the plunger 10, is larger than the biasing force of the spring 12, the plunger 10 moves upward in the cylinder 8a to a position abutting the front end of the stopper portion 11a of the stopper bolt 11 and thereby closes the four bypass holes $8b_1$ to $8b_4$, other than the bypass hole $8b_0$ closest to the outer circumference shown in FIG. 2.

When the cooling load falls or the rotational speed of the compressor becomes higher, the suction pressure Ps acting on the chamber 406 of the control valve 40 falls below 2 atmospheres (gauge) and the diaphragm 405 and the valve body 403 rise pushed by the spring 408, so the valve portion of the control valve 40 opens. At this time, the high pressure Pc in the control pressure chamber Vc escapes from the valve chamber 409 through the valve portion to the suction pressure Ps side. The front end of the high pressure passage 8c communicates with the high pressure operating space of the center portion of the stationary scroll member 8 while maintaining a small gap g with the end plate 5p of the moving scroll member 5, so due to the throttling effect by the small gap g, even the small amount of refrigerant flowing from the high pressure passage 8c to the control valve 40 flows out through the valve portion of the control valve 40 to the side of the chamber where the suction pressure Ps acts and as a result the control pressure Pc in the control pressure chamber Vc falls.

Due to this, the control pressure Pc acting on the plunger 10 falls and the biasing force of the spring 12 overcomes it, so the plunger 10 moves in the downward direction in FIG. 1 and reaches a position opening the second bypass hole $8b_1$ from the outer circumference shown in FIG. 2. In this state, the refrigerant in the operating space Va communicating with the bypass hole $8b_1$ flows out from the bypass hole $8b_1$ to the cylinder 8a in the compression process and flows back through the bypass hole $8b_0$ to the suction pressure chamber Vs. This de facto reduces the compressor capacity, causes the cooling capacity to drop, and causes the suction pressure Ps to rise. If the suction pressure Ps exceeds 2 atmospheres (gauge), the valve portion of the control valve 40 closes and the control pressure Pc is made to rise. As a result, the plunger 10 closes the bypass hole $8b_1$ and acts so as to once again place the compressor at maximum capacity.

Note that if the state where the suction pressure Ps is less than 2 atmospheres (gauge) continues, the valve portion of the control valve 40 maintains its open state and the control pressure Pc once again falls. By this, the plunger 10 further successively opens the bypass holes $8b_2$ and $8b_3$ and the operating spaces closer to the center portion communicate through the bypass holes $8b_2$ and $8b_3$ to the suction side. As a result, the refrigerant in the operating space Va flows back from $8b_3$ through the cylinder 8*a* to the suction pressure chamber Vs, so the real compressor capacity gradually falls.

As mentioned above, in the scroll-type variable-capacity compressor of the first embodiment of the present invention, when the suction pressure Ps is higher than 2 atmospheres (gauge), the pressure setting by the control valve 40, the group of bypass holes 8*b* are successively closed from the ones closer to the center and the capacity is increased, while when the suction pressure Ps is lower than 2 atmospheres (gauge), the group of bypass holes 8*b* are successively opened from the ones closer to the outer circumference and the capacity is reduced.

In a scroll-type variable-capacity compressor having the group of bypass holes 8*b* such as shown in the first embodiment (FIG. 2) of the present invention, the plunger 10 gradually opens the bypass holes from the outer circumference. The changes in the compressor capacity accompanying this will be explained using FIG. 4. FIGS. 4(*a*) to 4(*f*) show the changes in the operating space Va each 60° rotational angle of the revolution of the moving scroll member 5.

The bypass hole $8b_0$ at the outermost circumference opens to the suction space Vs at all times, so when the plunger 10 closes the bypass holes $8b_1$ to $8b_4$, the compressor capacity becomes that of two of the operating spaces $V_{50}$ and 100 percent discharge capacity is achieved.

Next, if the plunger 10 moves and the bypass hole $8b_1$ second from the outer circumference opens, the compressor capacity becomes the sum of $V_{50}$ and $V_{35}$ shown in FIG. 4 and a substantially 85 percent capacity is achieved. The reason is that in the process of one of the two operating spaces enclosed by the two spiral vanes 5*v* and 8*v* in FIG. 4(*a*) shrinking to $V_{35}$ in FIG. 4(*d*), the refrigerant in the operating space Va flows back from the bypass hole $8b_1$ to the suction pressure chamber Vs and the capacity falls to $V_{35}$. After this, the refrigerant is trapped in the operating space Va for the first time and heads to the center portion, for an effective compression and discharge action.

Further, if the third bypass hole $8b_2$ opens in addition to the bypass holes $8b_0$ and $8b_1$, refrigerant flows back from the bypass holes $8b_1$ to $8b_2$ to the suction pressure chamber Vs until reaching the sum of the capacities shown as $V_{35}$ in FIG. 4(*d*) and $V_{25}$ in FIG. 4(*a*), that is, 60 percent capacity.

In the same way, if the plunger 10 moves and four bypass holes $8b_0$ to $8b_3$ are opened, the capacity becomes 35 percent, that is, the sum of the $V_{25}$ shown in FIG. 4(*a*) and the $V_{10}$ shown in FIG. 4(*c*). When all five of the bypass holes $8b_0$ to $8b_4$ open, the capacity becomes 15 percent shown as $V_{15}$ in FIG. 4(*e*).

Figure 5:
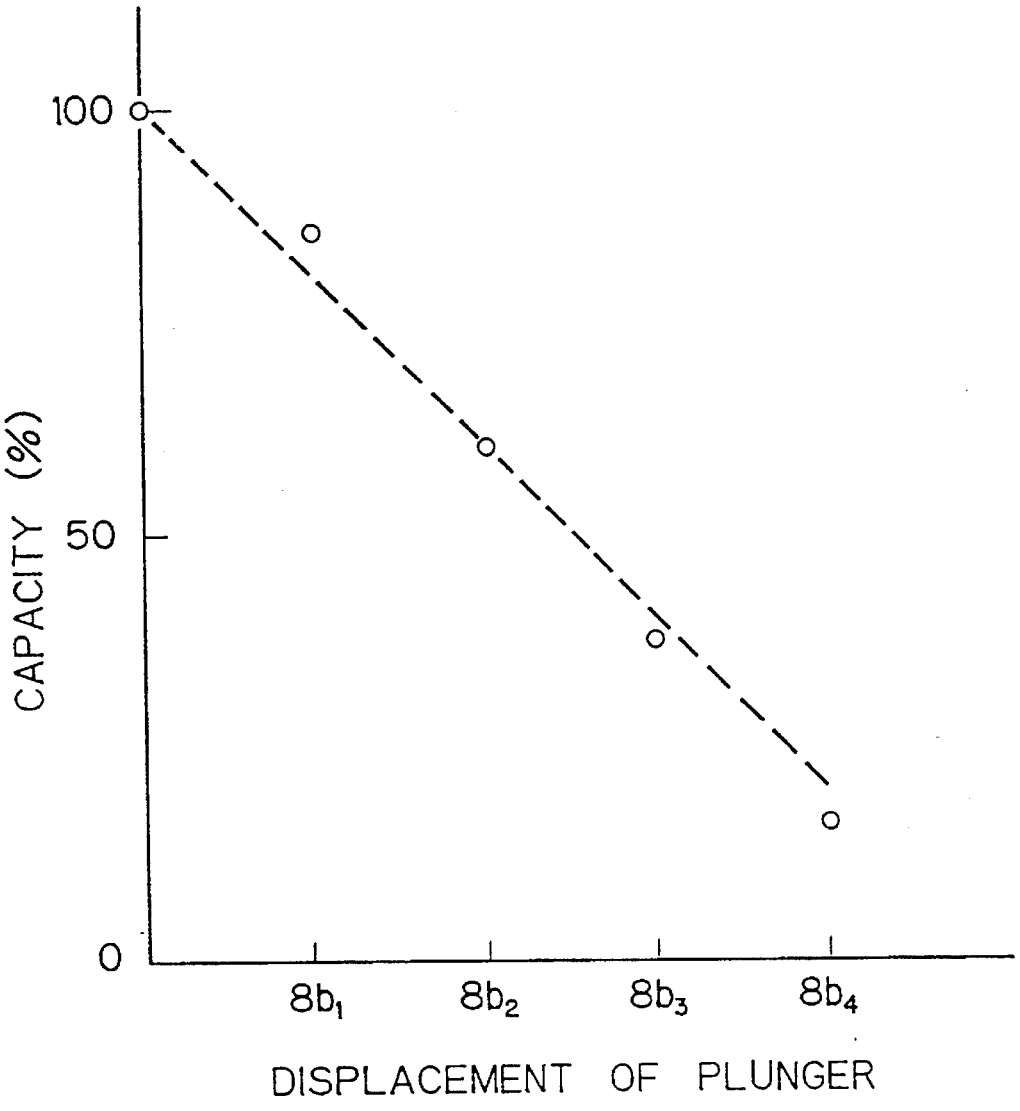
FIG. 5 is a graph showing the changes in the discharge capacity due to the successive opening of the bypass holes along with the displacement of the plunger in the first embodiment.

The above results are summarized in a graph shown in FIG. 5. The horizontal axis shows the amount of displacement of the plunger 10, while the vertical axis shows the compressor capacity. By the successive opening of the group of bypass holes $8b_1$ to $8b_4$ along with the movement of the plunger 10, it is possible to realize substantially equal intervals of continuous change in capacity.

According to the first embodiment of the present invention, by employing the simple construction wherein a single plunger 10 opens and closes the group of bypass holes 8*b* arranged at substantially equal pitches from the outer circumference of the stationary scroll member 8 to the center, it is possible to provide a substantially continuous variable-capacity mechanism of a scroll compressor even with fewer parts. Further, by setting the diameters of the four bypass holes $8b_1$ to $8b_4$ to substantially the same size as the thickness of the spiral vane of the moving scroll member 5, it is possible to prevent the backflow of the refrigerant over the vane from the operating spaces closer to the center to the operating spaces closer to the outer circumference in the state where the vane reaches the positions of the bypass holes, so no reduction in the compression efficiency is caused. On the other hand, by arranging the group of bypass holes 8*b* at positions offset from the center portion of the end plate 8*p* of the stationary scroll member 8, it is possible to arrange a discharge opening 8*f* and reed valve 13 at the center of the stationary scroll member 8, so the processability and assembly ability are also excellent.

As mentioned before, the compressor according to the first embodiment of the present invention uses the characteristic of a scroll compressor of having a plurality of operating spaces Va arranged on a line from near the outermost circumference of the spiral vane 8*v* of the stationary scroll member 8 to the center thereof and selectively bypasses the plurality of operating spaces through the group of bypass holes 8*b* made on the axial line of the same so as to make the discharge capacity of the compressor variable. At this time, the positions of the bypass holes of the group of bypass holes 8*b* are determined by the geometric positional relationship of the spiral vane 8*v* of the stationary scroll member 8 and the spiral vane 5*v* of the moving scroll member 5, but by suitably determining the axial line of the cylinder 8*a*, as shown in FIG. 5, it is possible to make the relationship between the positions of the bypass holes $8b_1$ to $8b_4$ and the capacities substantially linear.

Further, in the first embodiment, to operate the variable-capacity mechanism of the scroll-type variable-capacity compressor, a control pressure Pc is made to act on the plunger 10. As this control pressure, a high pressure is led from the operating space of the center of the compressor through the small gap g of the front end of the vane, to the control valve 40, whereby the small gap g is made to act as a throttle portion and the amount of supply of the high pressure refrigerant is restricted. Therefore, there is no need to provide a special throttle portion in the high pressure passage from the high pressure portion to the control valve 40 and there is no fear at all of the throttle portion closing. Also, as the control pressure Pc, use is made of the pressure of the refrigerant of the high pressure portion of the compressor itself, so there is no special need to provide a motor or other power source for operating the plunger 10 and it is possible to realize a variable capacity of the scroll compressor by a simple construction.

Note that in the first embodiment, when the scroll-type variable-capacity compressor stopped rotating, the pressure of the operating space Va supplying the high pressure to the control valve 40 becomes the same pressure as the suction pressure chamber Vs as the discharge pressure chamber Vd is blocked by the reed valve 13, so the control pressure Pc also becomes the same pressure as the suction pressure chamber Vs. Only the force of the spring 12 acts on the plunger 10. The plunger 10 stops at the position opening all the bypass holes 8*b*. Therefore, at the time of restart, in the minimum discharge capacity state where all the bypass holes 8*b* are open at all times, the drive torque is low and thereby the starting shock is small. When the scroll compressor is used as the refrigerant compressor for an automobile air-conditioner, it is possible to reduce the startup shock and the accompanying noise and possible to further improve the comfort of the automobile.

Figure 6:
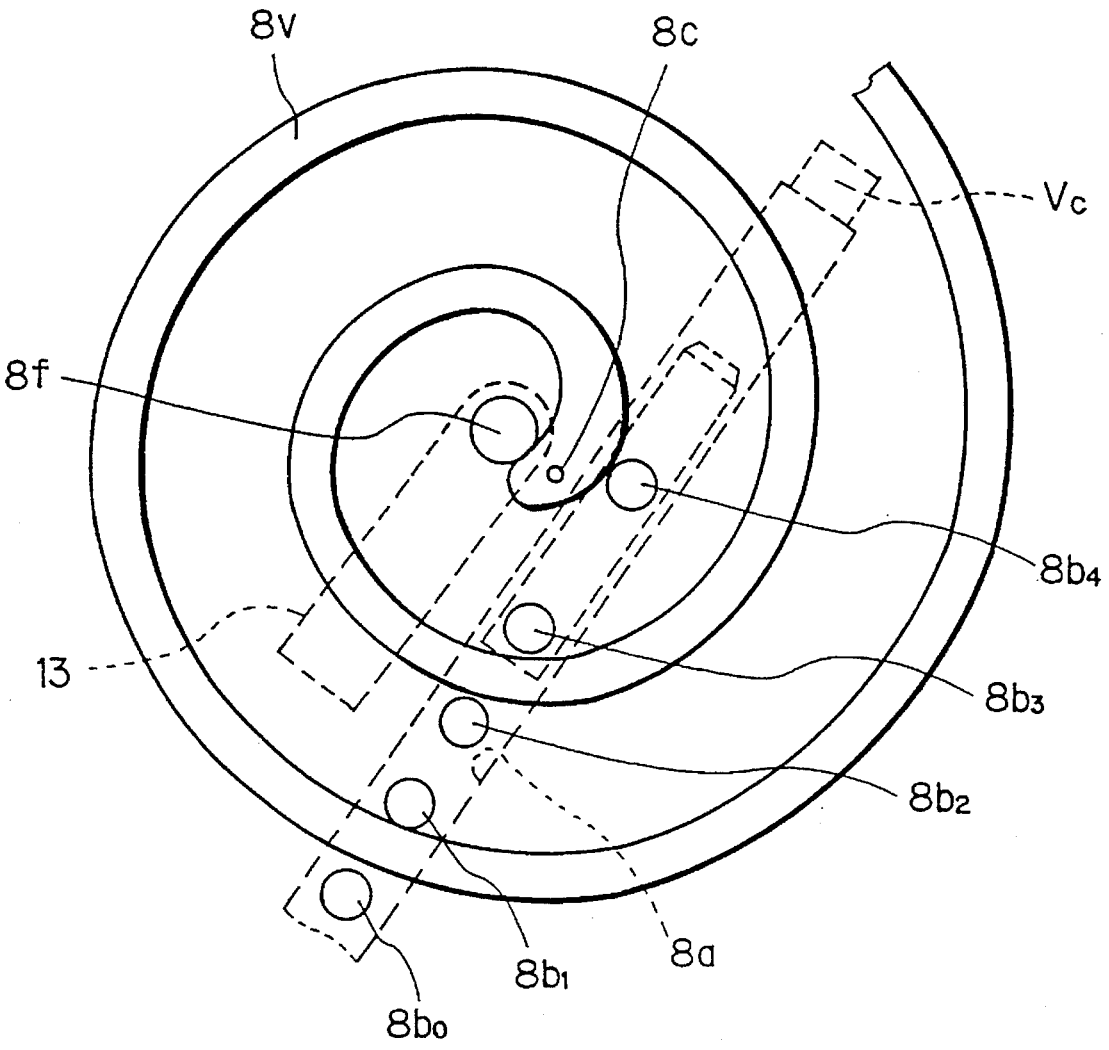
FIG. 6 is a side view of a stationary scroll member in a second embodiment of the present invention.
Figure 7:
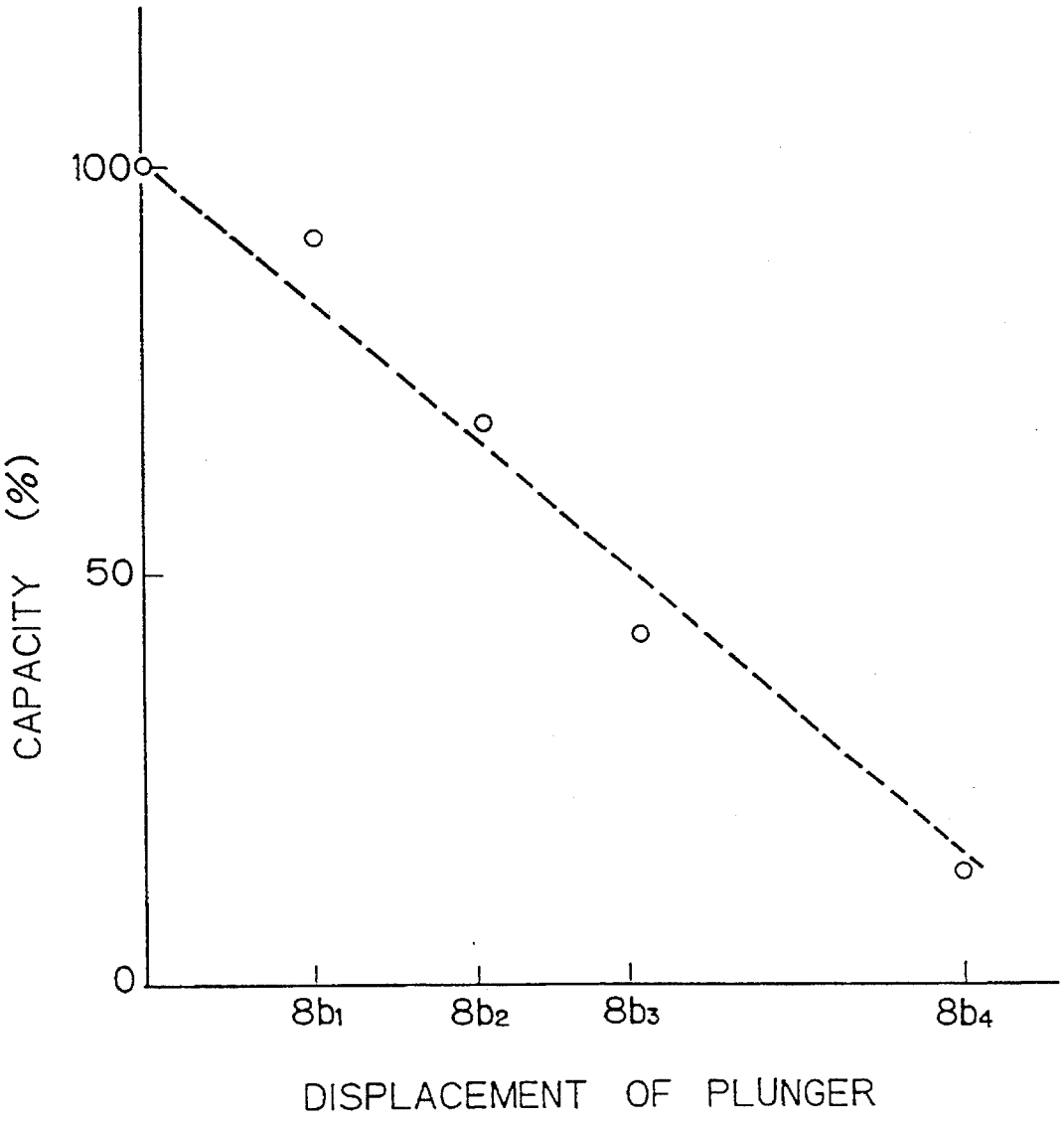
FIG. 7 is a graph showing the changes in the discharge capacity due to the successive opening of the bypass holes along with the displacement of the plunger in the second embodiment.

As a second embodiment, the case where the group of bypass holes 8*b* are provided at positions different from the case of the first embodiment shown in FIG. 1 will be shown in FIG. 6. As clear from this figure, in the second embodiment, the group of bypass holes 8*b* are positioned at the center of the stationary scroll member 8 so that the first bypass hole $8b_0$ opens at the outside of the spiral vane 8*v* at the portion of the vane at the opposite side to the outermost circumference. As shown in FIG. 7, they are set toward the center so that a step by step change in capacity is displayed, i.e., when the bypass hole $8b_1$ is open, the capacity is about 90 percent, when $8b_2$ is open, about 70 percent, when $8b_3$ is open, about 40 percent, and when $8b_4$ is open, about 15 percent. In this way, it is possible to make the region of change of capacity of the compressor continuously variable like with the first embodiment.

Note that the positions of the group of bypass holes 8*b* in the scroll-type variable-capacity compressor of the present invention are not generally limited to those in FIG. 2 and FIG. 6. The point is that a plurality of bypass holes 8*b* be disposed substantially linearly from the outer circumference of the end plate 8*p* of the stationary scroll member 8 toward the center portion of the same.

Further, in the first and second embodiments, the suction pressure Ps and the discharge pressure Pd were used and the control pressure Pc was controlled by the control valve 40, but the control pressure Pc may also be controlled electrically by a solenoid valve.

Figure 8:
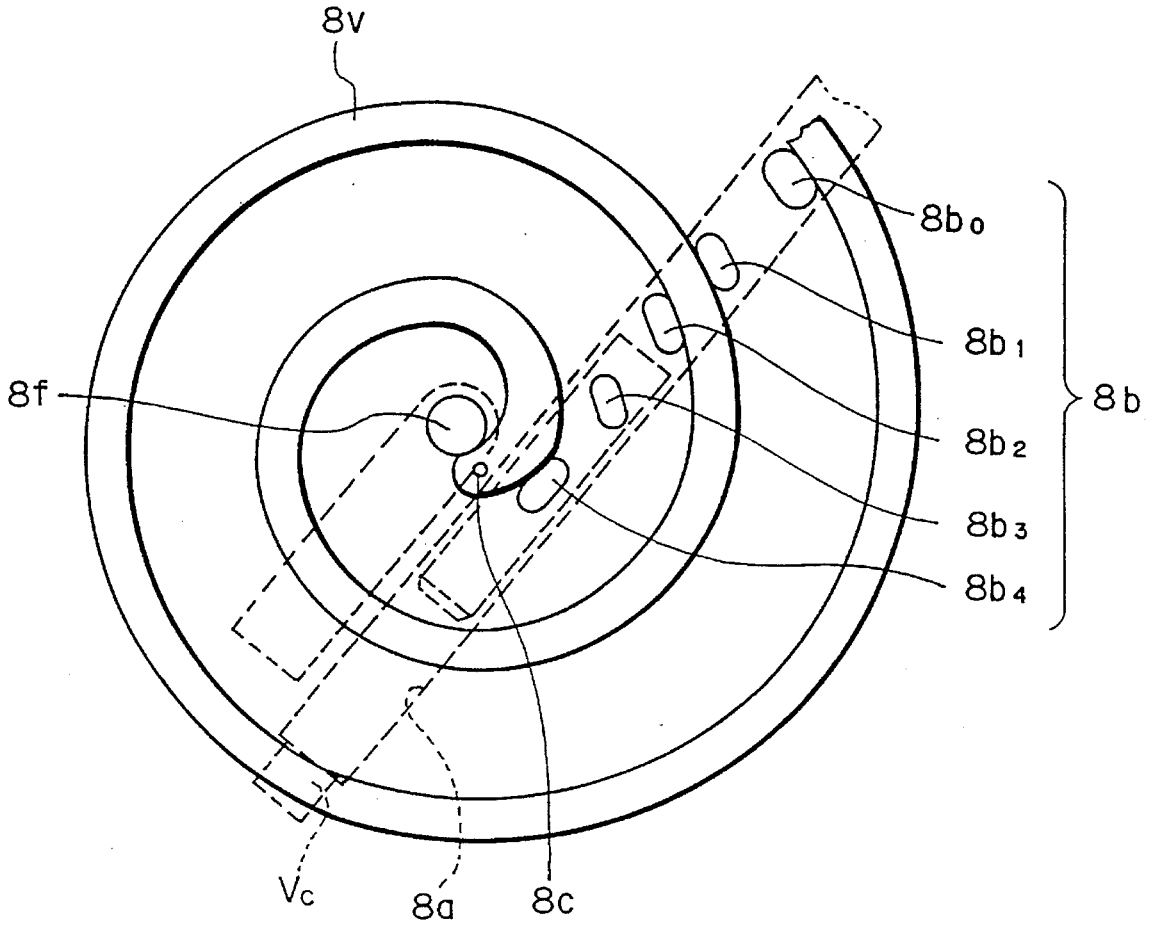
FIG. 8 is a side view of a stationary scroll member in a third embodiment.

A third embodiment of the present invention is shown in FIG. 8. The bypass holes 8*b* need not only be circular holes as shown in the first embodiment (FIG. 2), but may be elliptical holes or elongated holes. In FIG. 8, an embodiment of elongated bypass holes 8*b* is shown. In this embodiment, the bypass holes 8*b* are made to match with the shape of the spiral vane of the moving scroll member 5 and to have a width narrower than the width of the vane (thickness) so as to enable a wider flow path area of the bypass holes 8*b* to be obtained. Therefore, it is possible to cause a fluid to be compressed, like a refrigerant, to be reliably bypassed with a small resistance of passage at the time of bypass and it is possible to prevent the variable range of the capacity from narrowing at the time of high speed operation. In particular, the effect is great when the maximum suction capacity of the compressor is large.

Next, FIG. 9 to FIG. 15 show a fourth embodiment of the scroll-type variable-capacity mechanism of the present invention. This case too shows an application to a refrigerant compressor of an automobile air-conditioner. Portions the same as in the first embodiment etc. explained earlier are given the same reference numerals and explanations of the same are omitted.

The rotational shaft 1, front housing 2, and bearings 3 and 4 are substantially the same as those used for the scroll compressor of the first embodiment shown in FIG. 1. The moving scroll member 15 is also provided with an approximately 2.4 turn spiral vane 151 similar to that of the first embodiment, but there are some differences in the joint construction of the end plate 152 and the rotational shaft 1. At the side of the end plate 152 opposite to the spiral vane 151, a protruding shaft portion 153 is integrally attached. The rotational shaft 1 has a bearing support portion 1*b* supported by the bearing 4 integrally attached to it. Inside, a space 1*c* is formed. An eccentric pin 1*d* is provided protruding in the axial direction at a position eccentric from the rotational shaft 1. At the eccentric pin 1*d* is pivoted a counterweight 16. In a cylindrical hole 161 formed in the counterweight 16 and positioned eccentric from the rotational shaft 1 there is rotatably supported a shaft portion 153 which protrudes from the end plate 152 of the moving scroll member 15 through the needle bearing 162.

Between the front housing 2 and the end plate 152 of the moving scroll member 15, there is constructed a rotation preventing mechanism 17 for the moving scroll member 15, comprised of a plurality of circular depressions formed by double annular members mounted on the end faces of the same and a plurality of balls 7 inserted between them.

Reference numeral 18 is a stationary scroll member, the outer shell of which serves also as the center housing 183 provided with the suction port 181 and discharge port 182. The stationary scroll member 18 is also comprised of a spiral vane 184 formed in an approximately 2.4 turn involute shape integral with the end plate 185. The suction pressure chamber Vs formed at the inner circumference of the center housing 183 is communicated with the suction port 181 at all times. Reference numeral 19 is a rear housing, which is integrally fastened by bolts, not shown, together with the front housing 2 and the stationary scroll member 18.

Figure 10:
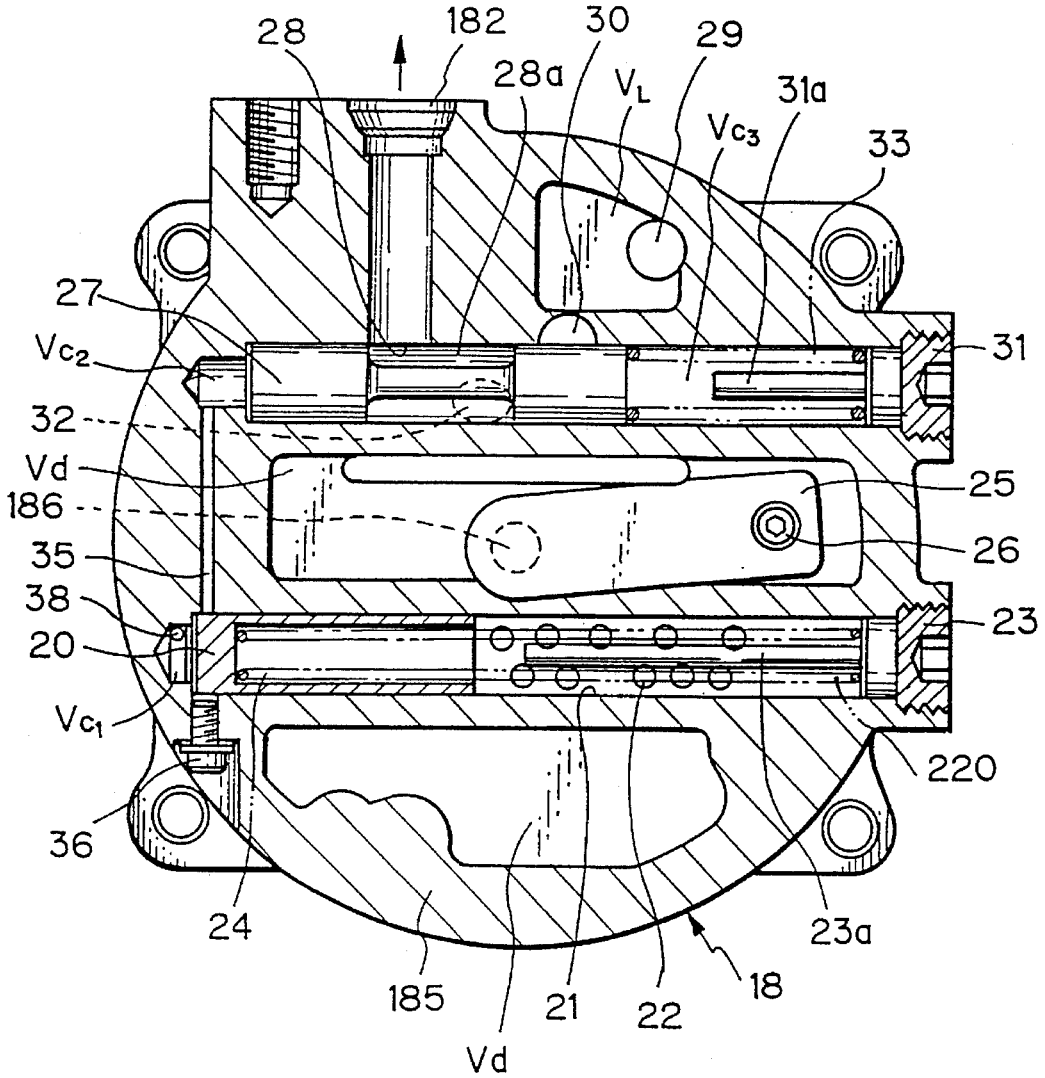
FIG. 10 is a sectional view along X—X in FIG. 9.

The variable-capacity mechanism in the fourth embodiment of the scroll compressor, characterizing the present invention, is built into the inside of the end plate 185 of the stationary scroll member 18. In FIG. 10, reference numeral 20 is a first plunger formed in a cylindrical shape and inserted in a reciprocally moving manner inside a first cylinder 21 provided in the end plate 185 of the stationary scroll member 18 in a direction perpendicular to the axial direction of the rotational shaft 1. The first cylinder 21 and the first plunger 20 correspond to the cylinder 8*a* and the plunger 10 in the first embodiment and are substantially the same in function, but differ from the case of the first embodiment in minor construction and the later mentioned related structures.

A plurality of bypass holes 22 are made so as to enable communication between the operating space $Va_1$ and the operating space $Va_2$ formed close to the outer circumference, among the plurality of operating spaces Va formed between the spiral vane 151 of the moving scroll member 15 and the spiral vane 184 of the stationary scroll member 18 and the first cylinder 21. The construction is such that the plunger 20 can successively block the 10 bypass holes 221 to 230 (see FIG. 14) of the group of bypass holes 22 except for the bypass hole 220 closest to the outer circumference. Further, as shown in FIG. 10, the first cylinder 21 and the plunger 20 form the first control pressure chamber $Vc_1$ at the left end of the inside of the first cylinder 21. Note that 23 shows a stopper bolt, 23*a* a stopper portion, and 24 a coil spring. These resemble the stopper bolt 11 and the spring 12 in the first embodiment.

A discharge port 186 is provided which communicates the operating space $Va_3$ at the center among the plurality of operating spaces Va formed between the two spiral vanes 151 and 184 with a discharge pressure chamber Vd formed between the rear housing 19 and the end plate 185 of the stationary scroll member 18. A thin reed valve 25 which can open and close the same is affixed to the end plate 185 by bolts 26.

Reference numeral 27 is a second plunger formed in a twin-head shape and inserted in a reciprocally moving manner in the second cylinder 28 provided in the end plate 185 of the stationary scroll member 18. The discharge port 182 and suction bypass port 30 open in the second cylinder 28 as shown in FIG. 10. The port 30 communicates with the low pressure chamber $V_L$. The low pressure chamber $V_L$ communicates with the suction pressure chamber Vs through the bypass port 29. The second plunger 27 is formed in a twin-head shape so as to enable opening and closing of both the discharge port 182 and the suction bypass port 30 with respect to the space 28*a* in the second cylinder 28.

Figure 11:
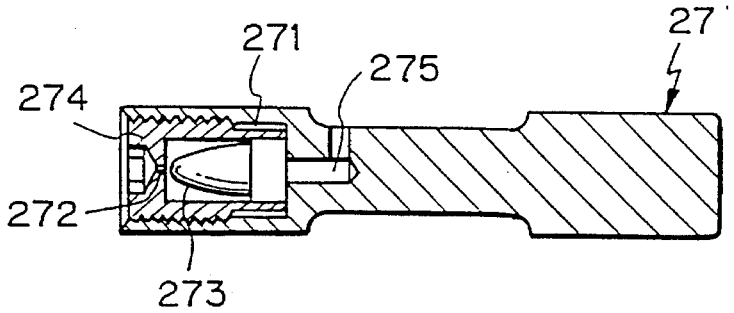
FIG. 11 is a sectional view of a second plunger shown in FIG. 10.

The detailed construction of the second plunger 27 is shown in FIG. 11. At the left end of the plunger 27 is formed the circular depression 271. In this, a filter member 274 having a throttle 272 and a filter 273 is screwed. The plunger 27 is further provided with a communication hole 275 which communicates the left side space of the filter 273 and the space 28*a* in the cylinder 28 at all times. Reference numeral 31 is a stopper bolt which is provided integrally with a stopper portion 31*a* comprised of a thin diameter column extending in the second cylinder 28. The stopper bolt 31 is screwed into the end plate 185 of the stationary scroll member 18 so that the front end of the stopper portion 31*a* is at a position enabling the amount of movement of the second plunger 27 in the axial direction to be restricted to a predetermined range.

As shown in FIG. 10, a second control pressure chamber $Vc_2$ is formed at the side of the left end of the second plunger 27 in the second cylinder 28. Further, at the right end side, a third control pressure chamber $Vc_3$ which is closed by the stopper bolt 31 is formed. Reference numeral 32 is a cylinder port which opens to the cylinder 28 and which communicates the discharge pressure chamber Vd and the space 28*a* at all times regardless of the movement of the plunger 27 (see also FIG. 13). Reference numeral 33 is a coil spring, which is disposed between the stopper bolt 31 and the plunger 27. The plunger 27 is pushed to the left in FIG. 10, that is, in the direction closing the suction bypass port 30.

Figure 12:
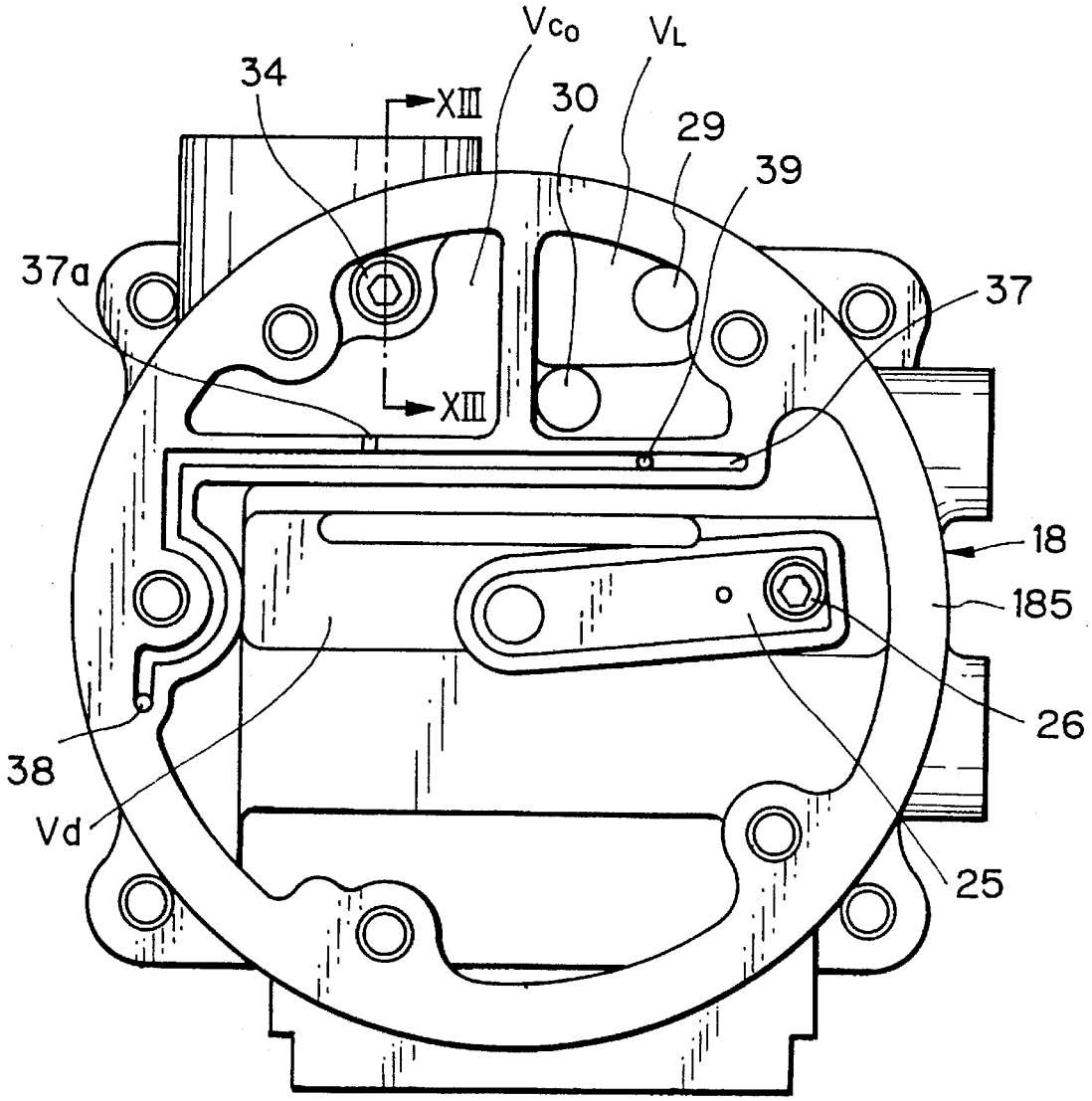
FIG. 12 is a side view of the stationary scroll member shown in FIG. 9 and FIG. 10 seen from the rear housing side.
Figure 13:
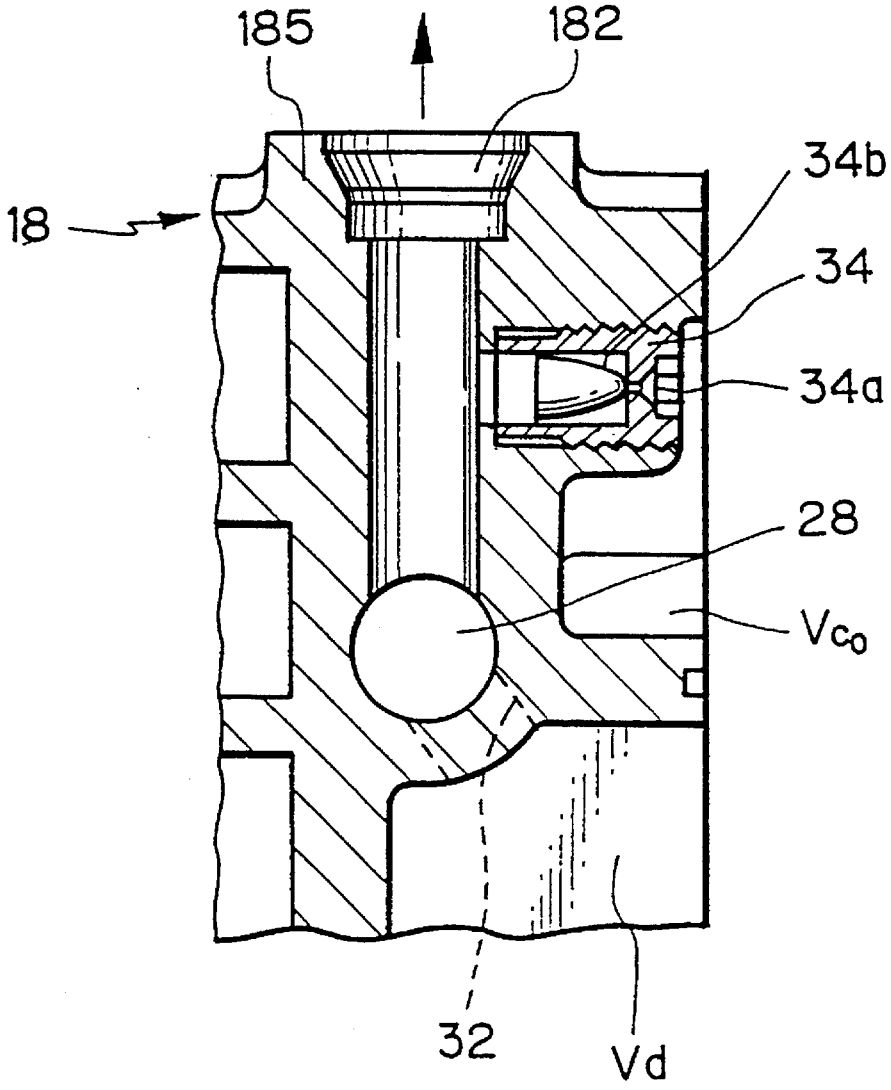
FIG. 13 is a sectional view along XIII—XIII in FIG. 12.

In FIG. 13, reference numeral 34 is a filter member, which is provided with a throttle 34*a* and a filter 34*b*. The filter member 34 communicates the control pressure chamber $Vc_0$ (see also FIG. 12 and FIG. 15) formed in part between the end plate 185 of the stationary scroll member 18 and the rear housing 19 with the discharge port 182. In FIG. 10, reference numeral 35 is a control pressure hole which communicates the first control pressure chamber $Vc_1$ and the second control pressure chamber $Vc_2$ at the left end of the first cylinder 21 and the second cylinder 28, while 36 is a plug screwed in the end plate 185 for closing the opening of the control pressure hole 35. In FIG. 12, reference numeral 37 is a control pressure groove cut into the end face of the rear housing 19 side of the end plate 185 of the stationary scroll member 18. This communicates the first control pressure chamber $Vc_1$and the third control pressure chamber $Vc_3$ through the control pressure holes 38 and 39 and communicates these to the control pressure chamber $Vc_0$ through the branch groove 37*a* as well.

Figure 9:
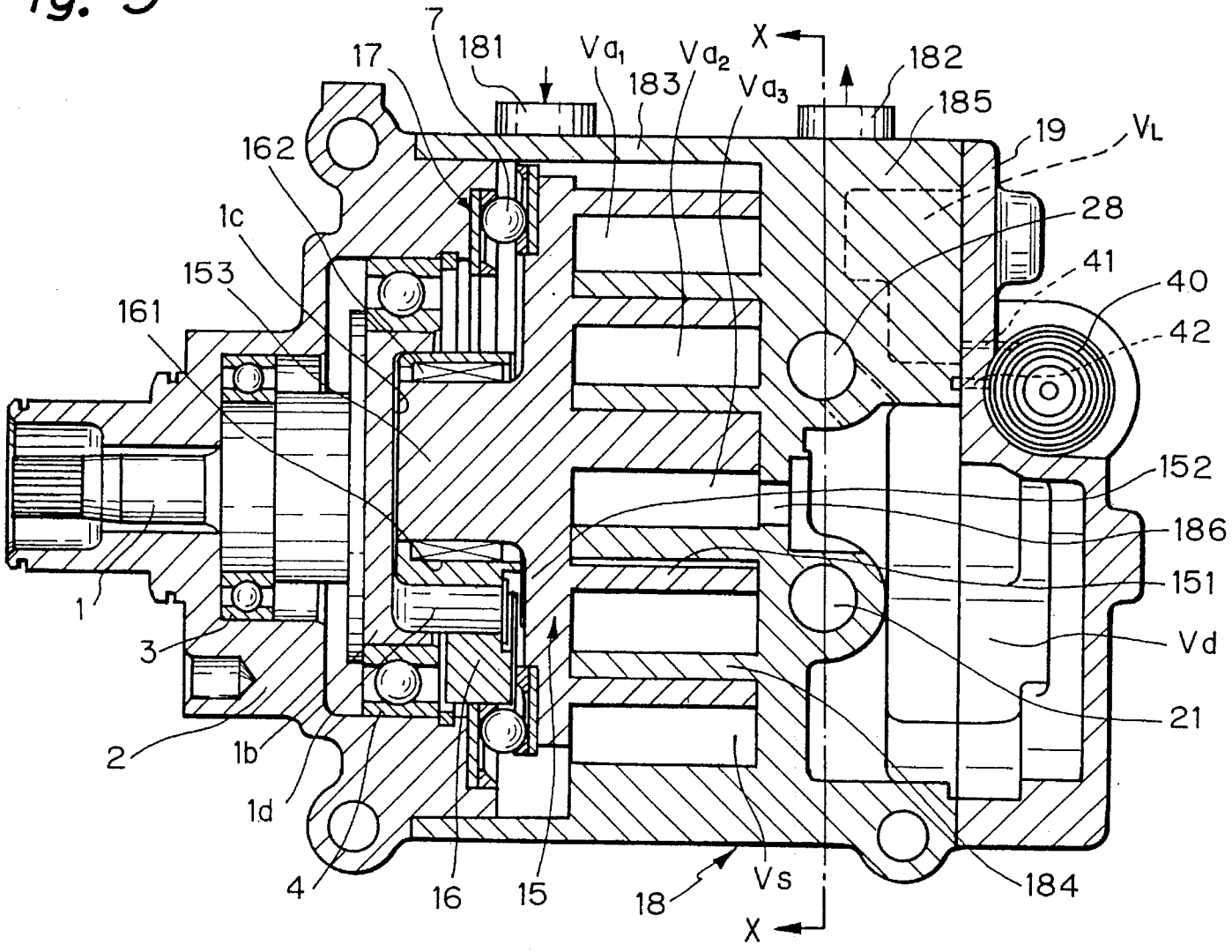
FIG. 9 is a front sectional view of a fourth embodiment of the present invention.
Figure 19:
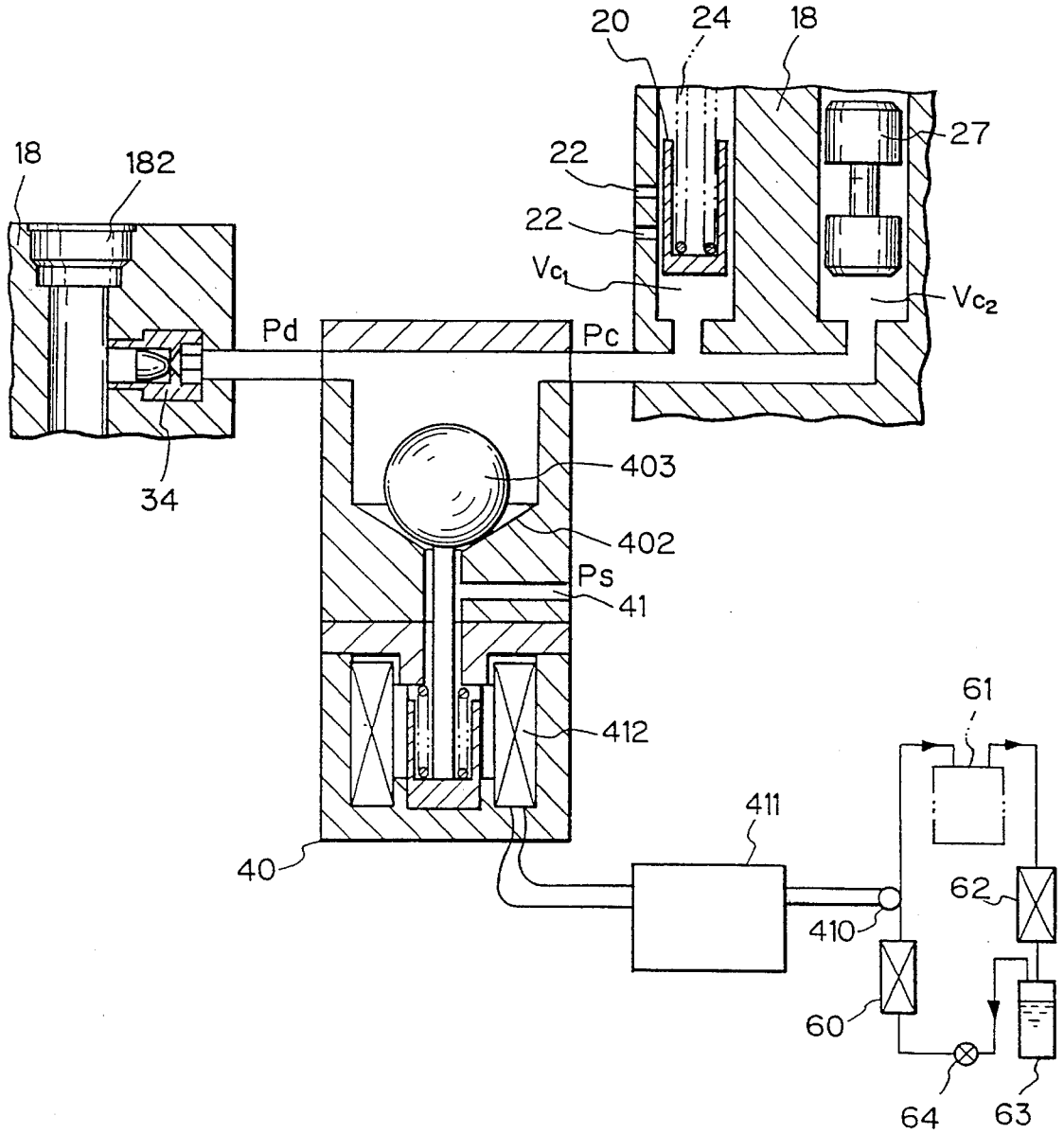
FIG. 19 is a constitutional view of the control valve and the pressure controlling system relating to the same for showing an eighth embodiment of the present invention.

In FIG. 9, reference numeral 40 is a control valve built into the rear housing 19. This itself has substantially the same construction as that used in the first embodiment (see FIG. 3), as shown in FIG. 19. Reference numeral 41 is a low pressure passage which communicates the control valve 40 and the low pressure chamber $V_L$, while 42 is a high pressure passage which communicates the control valve 40 and the control pressure groove 37.

Figure 14:
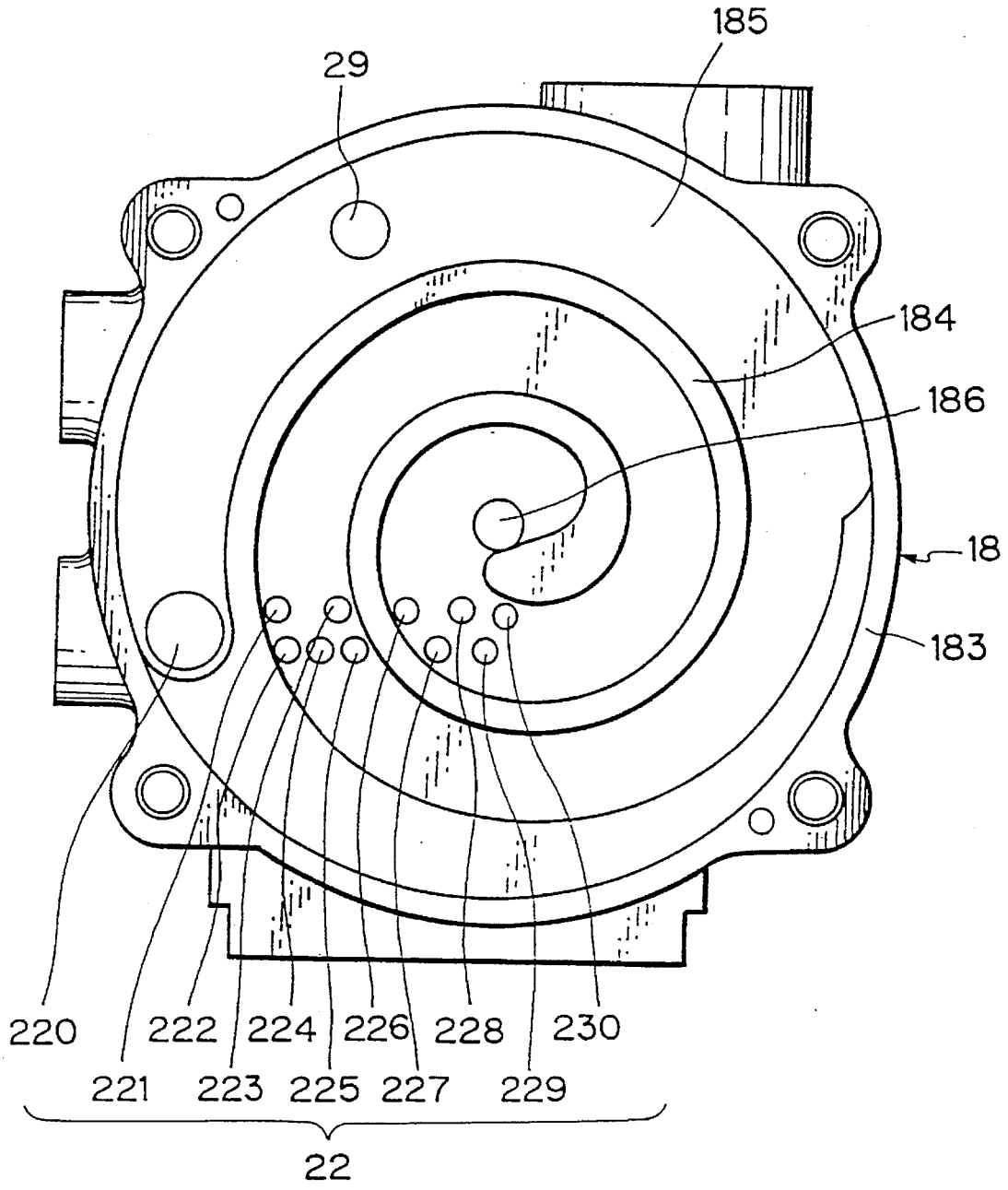
FIG. 14 is a side view of the stationary scroll member shown in FIG. 9 seen from the moving scroll member side.

The opening positions of the group of bypass holes 22 are shown in FIG. 14. In the fourth embodiment, the group of bypass holes 22 were comprised of 11 round holes 220 to 230. The bypass hole 220 nearest the outer circumference was made at a position touching the outside of the portion of the spiral vane 184 of the stationary scroll member 18 about 180 degrees back from the outermost end. Conversely, the bypass hole 230 nearest the center is made at a position touching the outside of the innermost circumference portion of the spiral vane 184. Between the two bypass holes 220 and 230 are made nine bypass holes 221 to 229 at substantially equal intervals and away from the spiral vane 184 of the stationary scroll member 18. Among the group of bypass holes 22, the 10 bypass holes 221 to 230 other than the bypass hole 220 closest to the outer circumference are set to a diameter substantially equal to the thickness of the spiral vane 151 of the stationary scroll member 15. Further, the bypass hole 220 closest to the outer circumference opens to the right end of the first cylinder 21 as shown in FIG. 10 and communicates the inside of the cylinder 21 to the suction pressure chamber Vs at all times.

Figure 15:
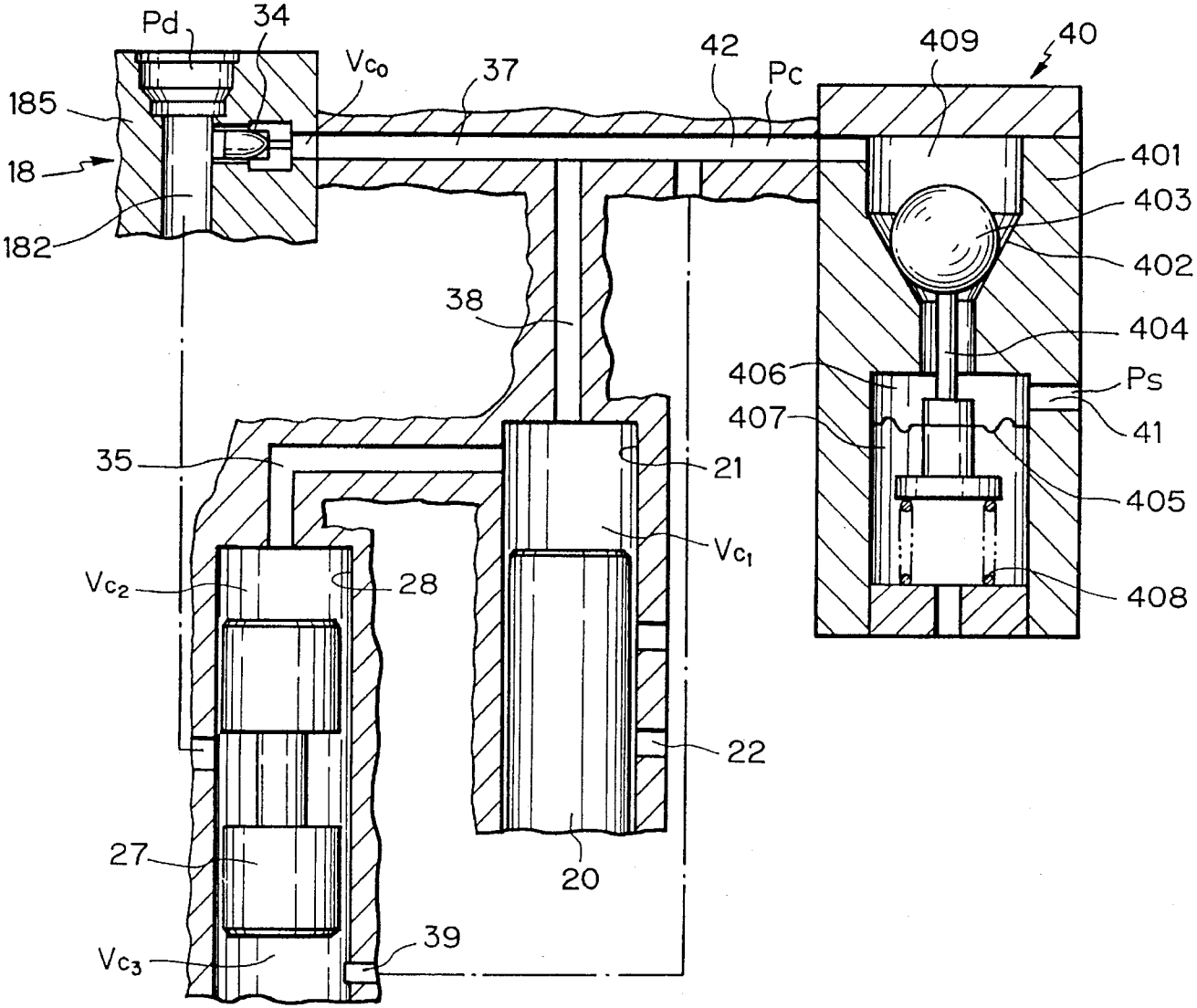
FIG. 15 is a constitutional view showing the control valve and the pressure controlling system relating to the same.

The related construction of the control valve 40 leading the control pressure Pc to the control pressure chambers $Vc_0$ to $Vc_3$ is shown in FIG. 15. The construction and the operation of the control valve 40 itself are substantially the same as those explained with reference to FIG. 3 in the first embodiment, so a detailed explanation of the same will be omitted here. In this case too, when the suction pressure Ps applied to the chamber 406 through the low pressure passage 41 is higher than 2 atmospheres (gauge), the control valve 40 closes to make the control pressure Pc higher, while when the suction pressure Ps is lower than 2 atmospheres, the control valve 40 opens to reduce the control pressure Pc.

Next, an explanation will be made of the operation of the fourth embodiment shown in FIG. 9 to FIG. 15. Only brief explanations will be given of portions the same as in the first embodiment. When the rotational shaft is driven and rotates, the moving scroll member 15, which is eccentric with respect to the rotational shaft 1, is forced to revolve through the eccentric pin 1*d* and the counterweight 16 in a state inhibited from a rotation by the rotation preventing mechanism 17. The counterweight 16 is pivoted at the bearing support portion 1*b* by the eccentric pin 1*d*, so the amount of eccentricity of the moving scroll member 15 with respect to the rotational shaft 1 can change slightly. Therefore, the contact pressure between the spiral vane 151 of the moving scroll member 15 and the spiral vane 184 of the stationary scroll member 18 is automatically adjusted to a suitable magnitude.

The operating space $Va_1$ near the outer circumference formed between the two spiral vanes 151 and 184 moves consecutively toward the center in the manner of $Va_2$ and $Va_3$ by the revolution of the moving scroll member 15, so the refrigerant sucked in from the suction port 181 and trapped in the operating space $Va_1$ is compressed, reaches the operating space $Va_3$, opens the reed valve 25 of the discharge port 186, and is pushed out to the discharge pressure chamber Vd. In the case of the fourth embodiment, as shown in FIG. 13, the compressed refrigerant passes from the discharge pressure chamber Vd through the cylinder port 32 to flow into the space 28*a* of the second cylinder 28 and, in the state where the second plunger 27 communicates the space 28*a* and the discharge port 182 as shown in FIG. 10, proceeds into the discharge port 182 and is sent to a condenser of a refrigeration cycle, not shown.

The operation in the case of changing the discharge capacity of the compressor of the fourth embodiment from the maximum capacity to 20 percent capacity will be now explained in detail.

When the cooling load of the automobile air-conditioner is large and it is necessary to drive the refrigerant compressor at maximum capacity, the suction pressure Ps acting on the chamber 406 of the control valve 40 shown in FIG. 15 becomes over 2 atmospheres (gauge), so the valve body 403 sits on the tapered valve seat 402 and the control valve 40 is in the closed state. Therefore, the pressure of the high pressure refrigerant flowing from the discharge port 182 through the throttled filter member 34 to the control pressure chamber $Vc_0$ shown in FIG. 12 and FIG. 13 and the pressure of the high temperature refrigerant flowing through the throttled filter member 274 built in the plunger 27 of the second cylinder 28 to the second control pressure chamber $Vc_2$ are adjusted as the control pressure Pc by the control valve 40. The thus formed control pressure Pc is led through the high pressure passage 42, the control pressure groove 37, the control pressure holes 38 and 39, etc. to the control pressure chambers $Vc_0$ to $Vc_3$. At this time, the first plunger 20 is acted on by a load corresponding to the product of the differential pressure of the control pressure Pc and the suction pressure Ps and the sectional area of the plunger 20, so when a force overcoming the biasing force of the coil spring 24 is generated, the first plunger moves in the cylinder 21 until a position abutting against the stopper bolt 23 and closes, among the group of bypass holes 21, the 10 bypass holes 221 to 230 other than the bypass hole 220 nearest to the outer circumference as shown in FIG. 14.

When the cooling load falls or when the rotational speed of the compressor becomes higher, the suction pressure Ps falls below 2 atmospheres (gauge) and the control valve 40 opens. As a result, due to the control pressure Pc acting on the control pressure chambers $Vc_0$ to $Vc_3$, high pressure refrigerant is led from the low pressure passage 41 to the low pressure chamber $V_L$ through the open control valve 40 and further escapes into the suction pressure chamber Vs. Further, the small amount of refrigerant which flows from the discharge port 182 through the throttled filter member 34 subjected to the throttling effect and the refrigerant flowing through the throttled filter member 274 built in the second plunger 27 to the second control pressure chamber $Vc_2$ flow out through the valve portion of the control valve 40 to the suction pressure chamber Vs. As a result, the control pressure Pc in the control pressure chambers $Vc_0$ to $Vc_3$ falls. Due to this, the effect of the control pressure Pc acting on the first plunger 20 becomes smaller and thereby when the biasing force of the coil spring 24 is greater, the plunger 20 moves to the left direction in FIG. 10 and moves to a position opening the second bypass hole 221 from the outer circumference shown in FIG. 14. In this state, when the refrigerant in the operating space Va corresponding to the bypass hole 221 is compressed, it flows out from the bypass hole 221 to the inside of the first cylinder 21 and further flows back through the bypass hole 220 nearest to the outer circumference to the suction pressure chamber Vs. Therefore, the discharge capacity of the compressor falls in real terms, the cooling capacity of the air-conditioner drops, and the suction pressure Ps rises.

Further, when the suction pressure Ps exceeds 2 atmospheres (gauge), the control valve 40 closes and the control pressure Pc rises, so the first plunger 20 operates to close the bypass hole 221 and once again make the compressor the maximum discharge capacity.

When the suction pressure Ps falls below 2 atmospheres (gauge), if the less than 2 atmosphere state of the suction pressure Ps continues even when the bypass hole 221 opens, the control valve 40 maintains the closed valve state, so the control pressure Pc further drops. Due to this, the first plunger 20 opens the next bypass hole 222, the operating space Va closer to the center portion communicates with the inside of the first cylinder 21, and the refrigerant compressed in the operating space Va flows back to the suction pressure chamber Vs, so the real discharge capacity of the compressor falls much more. In this case, in the fourth embodiment, since a larger number of bypass holes are provided than in the first embodiment, the change of the capacity becomes extremely smooth.

While the above operation is being performed, the pressure in the second control pressure chamber $Vc_2$ and the third control pressure chamber $Vc_3$ in the second cylinder 28 both become the control pressure Pc, so the plunger 27 in the cylinder 28 is pushed against the left end face of the cylinder 28 in FIG. 10 by the biasing force of the coil spring 33 and the discharge pressure chamber Vd and the discharge port 182 are communicated through the cylinder port 32. Further, the high pressure refrigerant flowing out from the discharge opening 186 passes through the discharge pressure chamber Vd, the cylinder port 32, and the second cylinder 28 to go toward the discharge port 182 and returns to the refrigeration cycle.

Even in the fourth embodiment, in the same way as the case of the first embodiment, when the suction pressure Ps becomes higher than 2 atmospheres (gauge) set by the control valve 40, due to the operation of the first plunger 20, the group of bypass holes 22 are successively closed from the center portion and the capacity increases, while conversely when the suction pressure Ps becomes lower than 2 atmospheres (gauge), the group of bypass holes 22 are successively opened from the outer circumference and the capacity is reduced. In this way, by opening and closing the group of bypass holes 22 by the first plunger 20, a change in capacity between the maximum capacity and 20 percent capacity is realized.

Next, the operation of the mechanism for making the discharge capacity variable in the range of 20 percent to 0 percent, the biggest feature of the fourth embodiment, will be explained. In the fourth embodiment, when all of the group of bypass holes 22 are open, that is, when a suction pressure Ps of less than 2 atmospheres (gauge) is sustained, if the cooling load further drops or the rotational speed of the compressor rises, it is possible to change the capacity from 20 percent to 0 percent by the operation of the plunger 27 in the second cylinder 28.

When the plunger 20 in the first cylinder 21 moves to the position abutting against the left end face of the cylinder 21 as shown in FIG. 10 and all of the group of bypass holes 22 are opened, the control pressure hole 35 is closed by the plunger 20, so the second control pressure chamber $Vc_2$ is blocked from the first control pressure chamber $Vc_1$. Further, the other control pressure chambers $Vc_0$ and $Vc_3$ are blocked. Therefore, the pressure inside the blocked second control pressure chamber $Vc_2$ rises due to the high pressure refrigerant flowing in from the discharge pressure chamber Vd through the filter member 274 of the second plunger 27 (see FIG. 11) and becomes higher than the pressures inside the other control pressure chambers $Vc_0$, $Vc_1$, and $Vc_3$, so a differential pressure is created between the second control pressure chamber $Vc_2$ and the third control pressure chamber $Vc_3$. A load corresponding to the product of this differential pressure and the sectional area of the plunger 27 acts on the plunger 27. When this force overcomes the biasing force of the coil spring 33, the second plunger 27 moves in the right direction in FIG. 10 until abutting against the stopper bolt 31, so the discharge port 182 is closed by the plunger 27 and the suction bypass port 30 opens. Due to this, the high pressure refrigerant in the discharge pressure chamber Vd escapes to the low pressure chamber $V_L$ through the space 28*a* and the suction bypass port 30 and returns completely to the suction pressure chamber Vs through the bypass port 29. The discharge capacity of the compressor therefore becomes 0.

During the above operation, the suction pressure chamber Vs and the discharge pressure chamber Vd are communicated, so the pressure in the discharge pressure chamber Vd falls and the high pressure refrigerant in the second control pressure chamber $Vc_2$ flows out through the filter member 274 in the second plunger 27 to the space 28*a* in the second cylinder 28, that is, the suction pressure chamber Vd, so the pressure in the second control pressure chamber $Vc_2$ also falls. At the same time, refrigerant of over 2 atmospheres (gauge) pressure flows in from the low pressure chamber $V_L$ through the low pressure passage 41 to the chamber 406 of the control valve 40 and the valve portion of the control valve 40 is closed, so the high pressure refrigerant in the refrigeration cycle, not shown, passes through the filter member 34 to flow to the control valve 40. The pressure of the refrigerant is led through the high pressure passage 42, the control pressure groove 37, and the control pressure holes 38 and 39 to the control pressure chambers $Vc_0$, $Vc_1$, and $Vc_3$, other than the second control pressure chamber $Vc_2$, as the control pressure Pc, so the pressure inside the control pressure chambers rise. Due to this, the load generated in accordance with the differential pressure between the second control pressure chamber $Vc_2$ and the third control pressure chamber $Vc_3$ falls from the biasing force of the coil spring 33, the second plunger 27 moves once again to a position abutting against the left end face of the second cylinder 28 in FIG. 10, and the discharge capacity is returned to 20 percent. By repeating this operation, the discharge capacity can be changed in the range of 20 percent to 0 percent as well.

However, when the scroll-type variable-capacity compressor of the fourth embodiment stops rotation, the pressure of the discharge pressure chamber Vd, the suction pressure chamber Vs, and the control pressure chambers $Vc_0$ to $Vc_3$ become completely equal, so only the biasing force of the coil springs 24 and 33 act on the first plunger 20 and the second plunger 27 and the first plunger stops at the position opening all of the group of bypass valves 22. Therefore, in the same way as the case of the first embodiment, the effect is obtained of a reduction in the torque shock at the time of restarting.

In particular, in the compressor according to the fourth embodiment, the two plungers 20 and 27 are controlled by a single control valve 40 and a change in capacity from 0 to 100 percent is made possible. The pressure inside the compressor is utilized as the control pressure Pc at that time, so there is no need for addition of a special control mechanism and the effect is achieved of a reduction of the weight of the compressor and a reduction of the costs.

Next, an explanation will be made of a fifth embodiment of the present invention shown in FIG. 16. In the same way as the second embodiment shown in FIG. 6 and the first embodiment shown in FIG. 2 differ, the fifth embodiment provides the group of bypass holes 22 at positions different from the fourth embodiment shown in FIG. 14. Even if the group of bypass holes 22 are provided at the positions shown in FIG. 16, it is possible to make the range of change of the discharge capacity of the compressor similar to that of the fourth embodiment.

Figure 16:
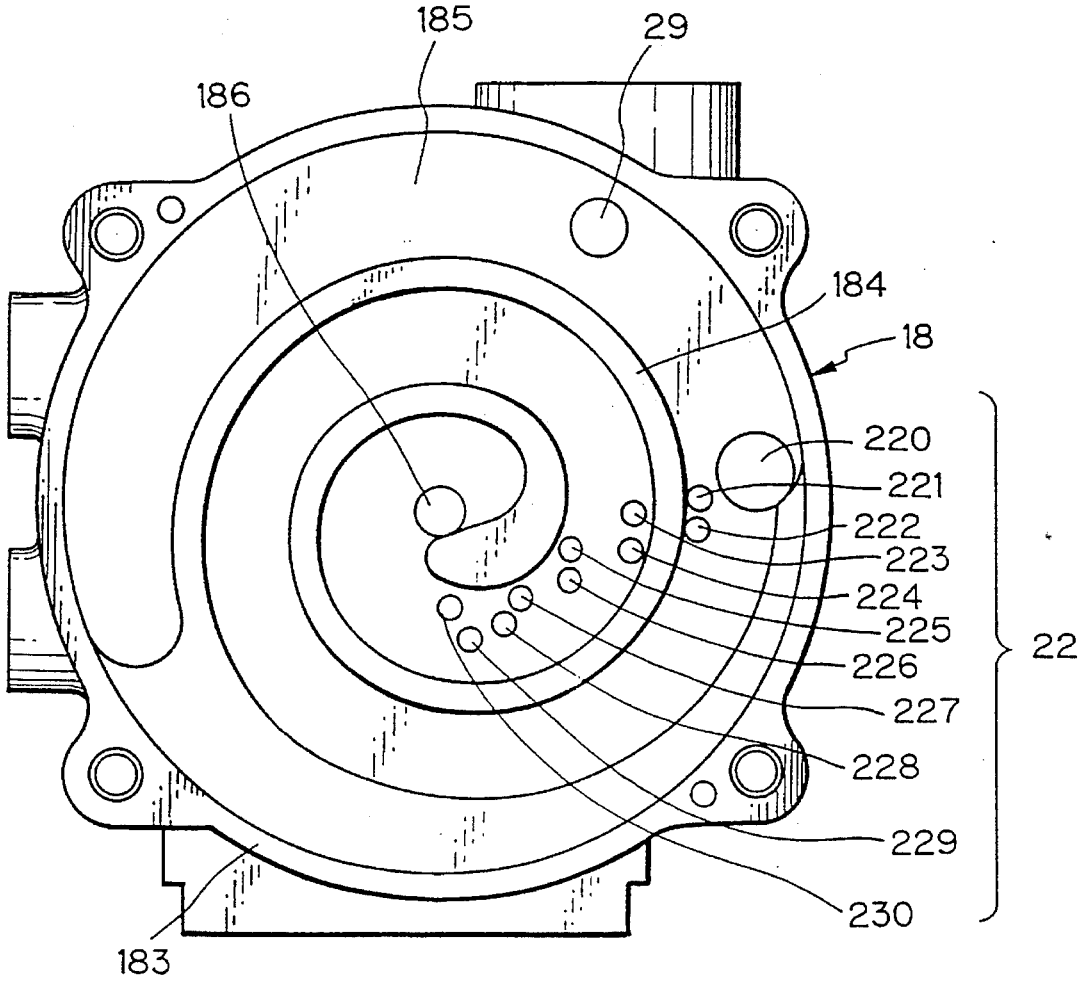
FIG. 16 is a sectional view showing a fifth embodiment of the present invention.

Note that in this embodiment, the positions of the group of bypass holes 22 is not limited to the positions shown in the embodiments of FIG. 14, FIG. 16, etc. Any arrangement is possible so long as the plurality of bypass holes are arranged in a substantially straight line from part of the outer circumference of the stationary scroll member to the center portion of the same.

Figure 17:
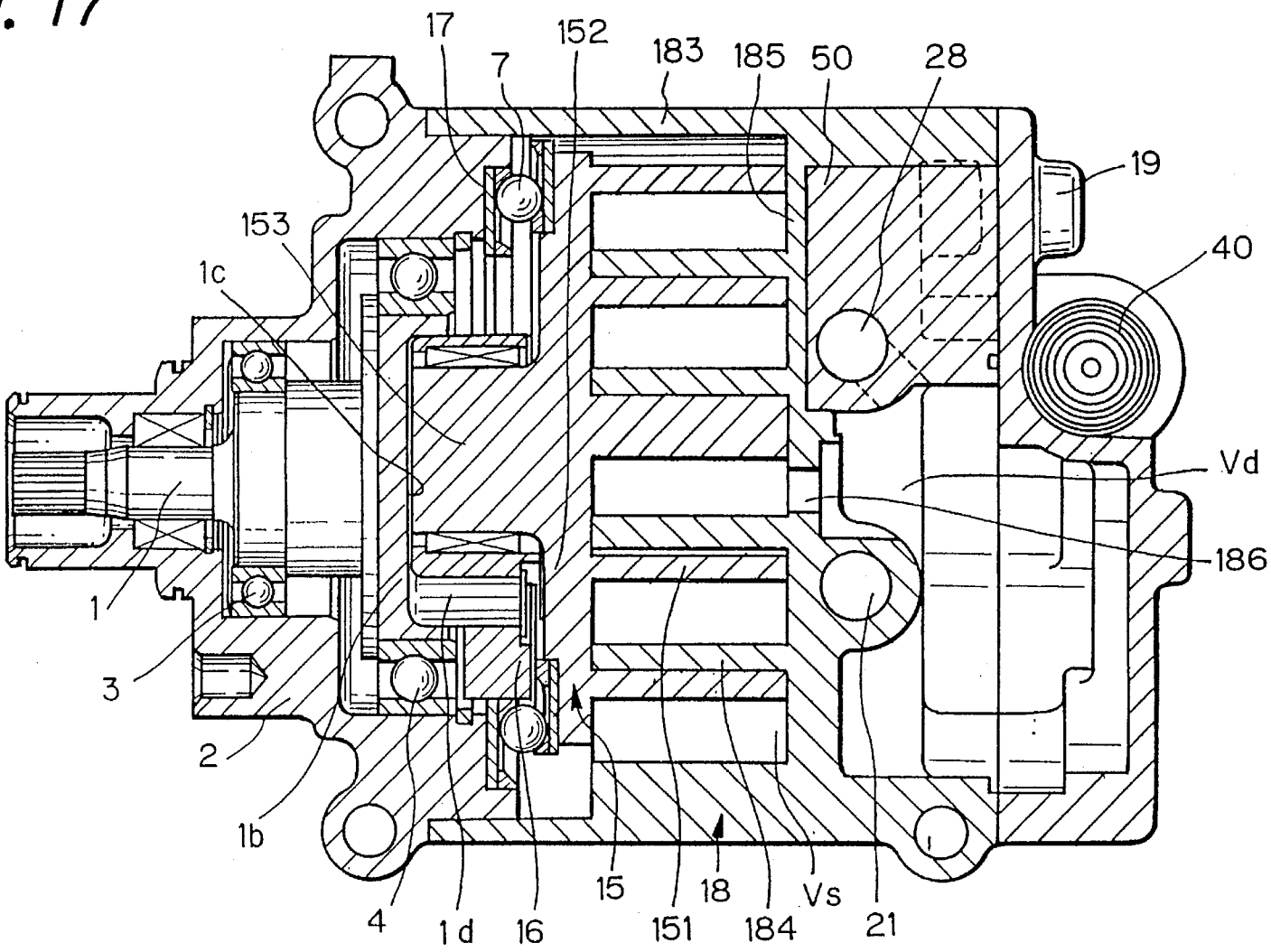
FIG. 17 is a front sectional view showing a sixth embodiment of the present invention.

FIG. 17 shows a sixth embodiment, in which the second cylinder 28 is not formed inside the end plate 185 of the stationary scroll member 18 as in the fourth embodiment shown in FIG. 10, but is formed in side another member 50 adjoining the stationary scroll member 18 and the rear housing 19. This facilitates processing of the second cylinder 28 and enables the excess thickness of the stationary scroll member 18 to be reduced. Further, the second cylinder 28 in this case may of course be formed at any position so long as the position and direction enable the construction and operation of the fourth embodiment.

Figure 18:
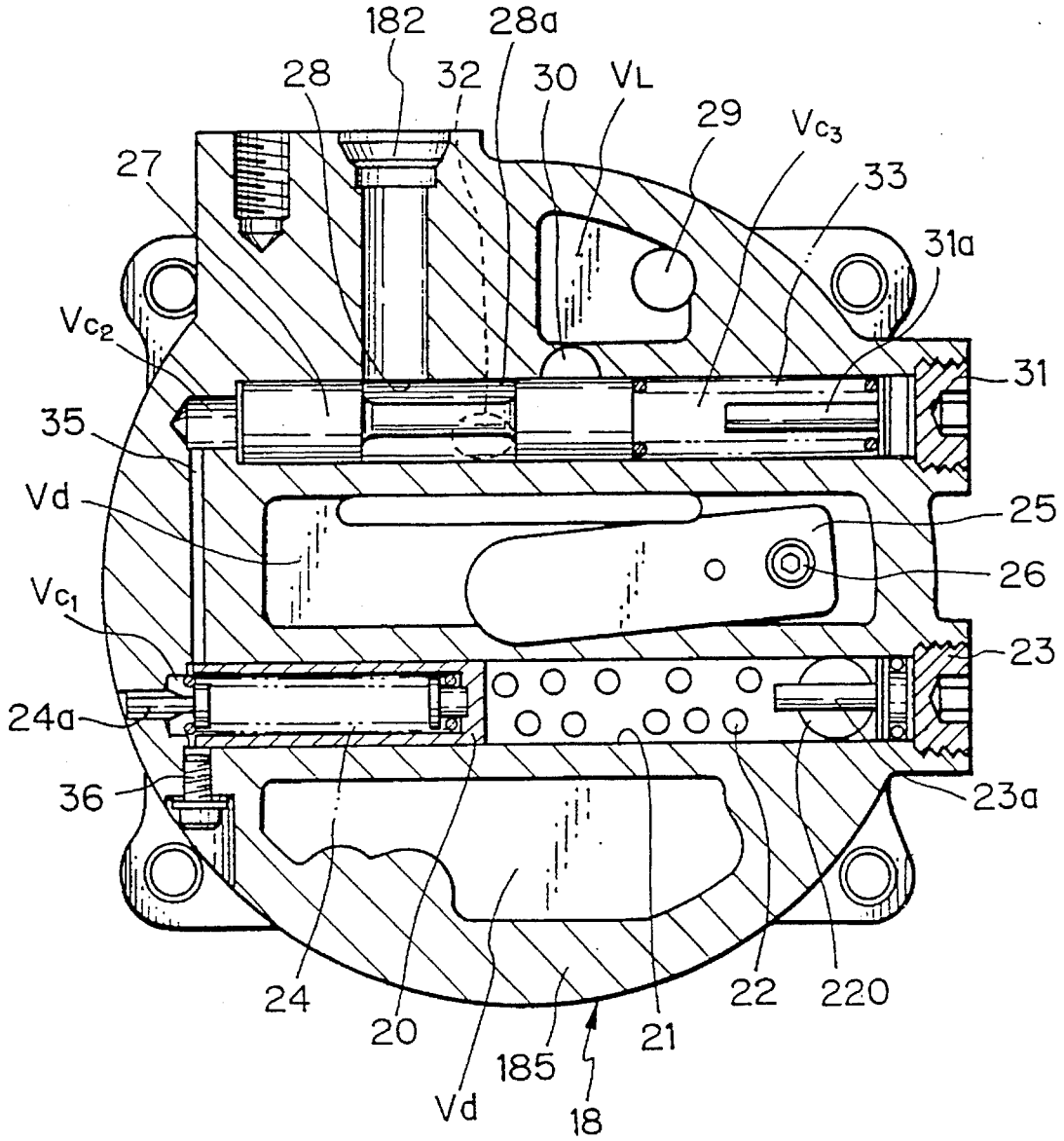
FIG. 18 is a sectional view of the seventh embodiment of the present invention similar to FIG. 10.

FIG. 18 shows a seventh embodiment of the present invention. The coil spring 24 in the first cylinder 21 in the fourth embodiment shown in FIG. 10 is changed a compression spring to a tension spring. In this case, one end of the coil spring 24 is attached by a suitable means to the first plunger 20 and the other end is attached by a suitable means to a screw 24*a*. Similarly, the coil spring 33 in the second cylinder 28 may be changed to a tension spring.

FIG. 19 shows an eighth embodiment of the present invention, in which the control valve 40 is made to be electrically controlled and driven. Using the related apparatus of the control valve 40 shown in FIG. 19, physical amounts showing the extent of cooling of the evaporator, such as the suction pressure of the compressor of the refrigeration cycle or the temperature of the air blown out from the evaporator, are detected by a sensor 410. The input signal from the sensor 410 and a target value are compared and an output signal is generated by a control circuit 411. Using this, the amount of current supplied to the solenoid coil 412 provided in the control valve 40 is controlled. This enables the opening and closing operation of the valve body 403 and the continuous control of the valve opening degree. Note that in FIG. 19, reference numeral 60 shows an evaporator of an automobile air-conditioner, 61 a compressor according to the present invention, 62 a condenser, 63 a receiver, and 64 an expansion valve. These form the refrigeration cycle. According to the eighth embodiment, it is possible to more accurately and quickly control the suction pressure of the compressor or the temperature of the air blown out from the evaporator.

The above fourth embodiment to eighth embodiment all were constructed so that the control valve 40 changed the control pressure Pc and thereby controlled the position (amount of movement in the axial direction) of the first plunger 20 and the second plunger 27, but the present invention is not limited to the construction of these embodiments. For example, it is also possible to provide electromagnetic drive apparatuses which directly drive the first plunger 20 and the second plunger 27 by electromagnetic force and to control the amount of current supplied to the two electromagnetic drive apparatuses by the control circuit 411 shown in FIG. 19 so as to control the amount of movement of the first plunger 20 and the second plunger 27 in the axial direction.

We claim:

1. A scroll-type variable-capacity compressor comprised of the following:

(a) a stationary scroll member having a spiral vane formed on a stationary end plate;

(b) a moving scroll member which has a spiral vane formed on an end plate supported so as to enable a revolution in a state with a rotation inhibited and able to oppositely engage with said spiral vane of said stationary scroll member and form a plurality of operating spaces between said spiral vanes;

(c) a suction pressure chamber introducing a low pressure fluid to an outer circumference of said plurality of operating spaces;

(d) a discharge pressure chamber in which high pressure fluid is discharged from a center of said plurality of said operating spaces passing through a discharge valve;

(e) a first cylinder which is formed along said end plate of said stationary scroll member from part of an outer circumference side of said end plate to a center side thereof;

(f) a group of bypass holes comprised of a plurality of bypass holes which open in said end plate of said stationary scroll member and thereby communicate a space in said first cylinder and said operating spaces;

(g) a communicating path which communicates said space in said first cylinder with said suction pressure chamber;

(h) a first plunger which is inserted in said first cylinder in a reciprocating moving manner and successively opens or closes said group of bypass holes to change a capacity of said compressor between a maximum capacity and a predetermined capacity;

(i) a second cylinder which communicates with said discharge pressure chamber at all times;

(j) a discharge port which opens to said second cylinder and discharges fluid to the outside;

(k) a suction bypass port which opens to said second cylinder and can cause fluid to bypass from said second cylinder to said suction pressure chamber side;

(l) a second plunger which is inserted in a reciprocating moving manner in said second cylinder, which opens and closes said discharge port and said suction bypass port, and which closes one of said ports when the other is opened and vice versa, to change the capacity of said compressor between said predetermined capacity and 0 percent;

(m) a control means for controlling the reciprocating movement positions of said first plunger and said second plunger; whereby (n) when the discharge capacity is changed between 100 percent capacity and said predetermined capacity, said first plunger opens and closes said group of bypass holes and said second plunger opens said discharge port in said second cylinder and closes said suction bypass port, while when said discharge capacity is changed between said predetermined capacity and 0 percent, said second plunger closes said discharge port and opens said suction bypass port in said second cylinder.

2. A scroll-type variable-capacity compressor as set forth in claim 1, wherein said control means is comprised of a control valve for providing a control pressure based on the suction pressure of the fluid in said suction pressure chamber, has control pressure chambers which causes said control pressure to act respectively on said first plunger and said second plunger, and said control pressure is used to control the reciprocal motion positions of said first plunger and second plunger.

3. A scroll-type variable-capacity compressor as set forth in claim 2, wherein said control valve has a pressure reactive member which displaces in accordance with said suction pressure and a valve body which is connected to said pressure reactive member, said valve body opening and closing between said low pressure chamber where the suction pressure acts and a chamber where the high pressure of said discharge port side acts so as to change said control pressure.

4. A scroll-type variable-capacity compressor as set forth in claim 1, wherein said control means is provided with:

a sensor which detects a physical amount related to the degree of cooling of the evaporator in the refrigeration cycle of the air-conditioner, a control circuit which issues an output signal based on the output signal of said sensor upon the input of said output signal of said sensor, and a control valve which receives the output signal of said control circuit and electrically controls the valve opening, said control valve being used to control the reciprocal movement position of said first plunger and second plunger.

5. A scroll type variable-capacity compressor as set forth in claim 1, wherein the pressure in a control pressure chamber of said second cylinder is introduced or blocked by said first plunger.

* * * * *